US009262967B2

(12) United States Patent
Asano et al.

(10) Patent No.: US 9,262,967 B2
(45) Date of Patent: Feb. 16, 2016

(54) DISPLAY APPARATUS AND DRIVING METHOD THEREFOR

(75) Inventors: Mitsuru Asano, Kanagawa (JP); Takao Tanikame, Kanagawa (JP)

(73) Assignee: JOLED Inc., Tokyo (JP)

( * ) Notice: Subject to any disclaimer, the term of this patent is extended or adjusted under 35 U.S.C. 154(b) by 1882 days.

(21) Appl. No.: 12/076,790

(22) Filed: Mar. 24, 2008

(65) Prior Publication Data

US 2008/0238835 A1 Oct. 2, 2008

(30) Foreign Application Priority Data

Mar. 30, 2007 (JP) ..... 2007-092809

(51) Int. Cl.
*G09G 3/30* (2006.01)
*G09G 3/32* (2006.01)

(52) U.S. Cl.
CPC ..... *G09G 3/3266* (2013.01); *G09G 3/3233* (2013.01); *G09G 2300/0819* (2013.01); *G09G 2300/0842* (2013.01); *G09G 2300/0852* (2013.01); *G09G 2320/0233* (2013.01)
USPC ..... 345/76; 345/92; 345/94; 345/98; 345/44; 345/45; 345/46; 345/55; 345/77; 345/78; 345/79; 315/169.1; 315/169.4

(58) Field of Classification Search
CPC ..... G09G 3/3233; G09G 2300/0842; G09G 2300/0861; G09G 2300/0819; G09G 2320/043; G09G 2300/0852; G09G 2300/0426; G09G 2310/0251; G09G 2310/0256; G09G 2320/0223; G09G 2320/0233; G09G 3/3291; G09G 2300/0809
USPC ..... 345/98, 99, 100, 92, 90, 44–46, 55, 345/76–80, 82, 84, 204, 211, 30, 33; 315/169.1, 169.4
See application file for complete search history.

(56) References Cited

U.S. PATENT DOCUMENTS

| | | | | |
|---|---|---|---|---|
| 6,014,122 | A * | 1/2000 | Hashimoto | 345/98 |
| 6,583,775 | B1 * | 6/2003 | Sekiya et al. | 345/76 |
| 7,821,484 | B2 * | 10/2010 | Choi | 345/98 |
| 2001/0017611 | A1 * | 8/2001 | Moriyama | 345/100 |
| 2003/0020702 | A1 * | 1/2003 | Matsuyama | 345/204 |
| 2003/0183850 | A1 * | 10/2003 | Pain et al. | 257/200 |

(Continued)

FOREIGN PATENT DOCUMENTS

| | | |
|---|---|---|
| JP | 08-234683 | 9/1996 |
| JP | 2002-514230 | 5/2002 |

(Continued)

OTHER PUBLICATIONS

Korean Office Action issued Oct. 20, 2014 for corresponding Korean Application No. 10-2014-0132299.

*Primary Examiner* — Olga Merkoulova
(74) *Attorney, Agent, or Firm* — Michael Best & Friedrich LLP

(57) ABSTRACT

A display apparatus disclosed herein includes a plurality of pixel circuits, each having a plurality of switches configured to receive a driving signal of a predetermined period and to be controlled for opening and closing operation by the driving signal, a drive circuit configured to control the open/closed state of the switches, being operable to scan the pixel circuits and open and close the switches in periods independent of each other.

9 Claims, 16 Drawing Sheets

(56) References Cited

U.S. PATENT DOCUMENTS

| | | | | |
|---|---|---|---|---|
| 2004/0196239 | A1* | 10/2004 | Kwon | 345/92 |
| 2005/0285830 | A1* | 12/2005 | Iwabuchi | 345/77 |
| 2006/0044292 | A1* | 3/2006 | Shen et al. | 345/204 |
| 2007/0124633 | A1* | 5/2007 | Kim | 714/726 |

FOREIGN PATENT DOCUMENTS

| | | | | | |
|---|---|---|---|---|---|
| KR | 2001-0039666 | A | | 5/2001 | |
| KR | 2007-0024143 | A | | 3/2007 | |
| KR | 2007-0024143 | A | * | 3/2007 | G09G 3/30 |

* cited by examiner

Background Art

Background Art

Background Art

Background Art

Background Art

Background Art

Background Art

FIG.13
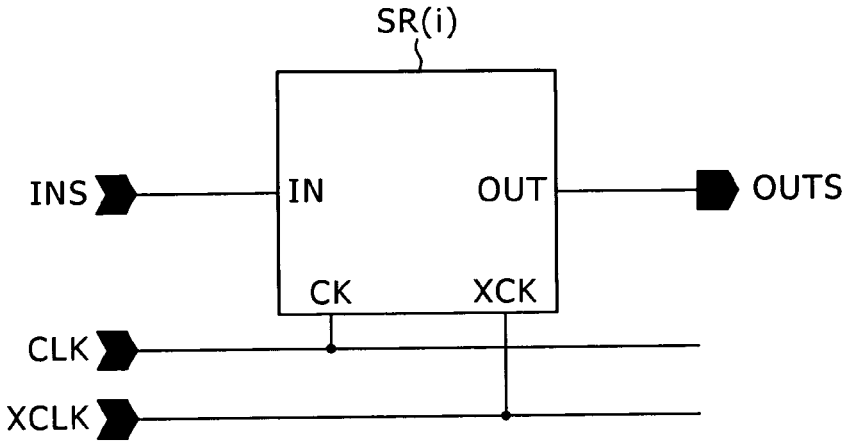
FIG.14A CLK
FIG.14B XCLK
FIG.14C INS
FIG.14D OUTS
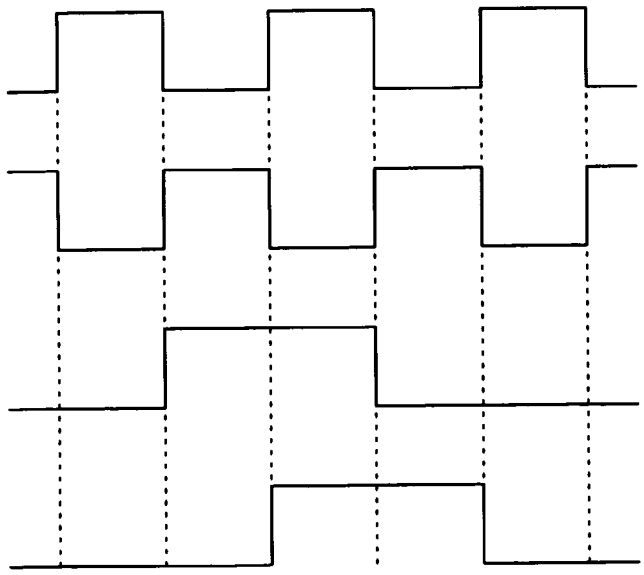

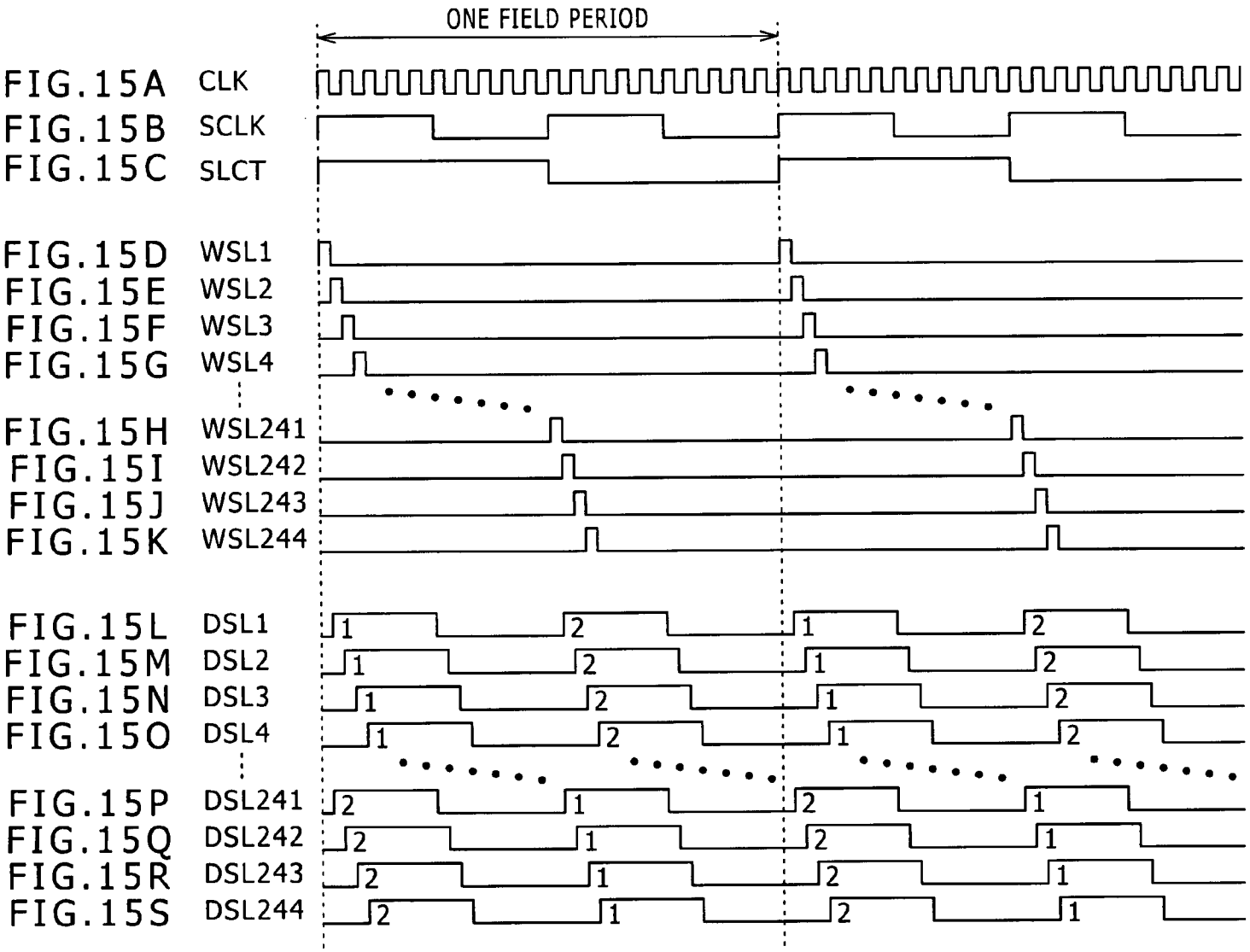
ONE FIELD PERIOD
FIG.15A CLK
FIG.15B SCLK
FIG.15C SLCT
FIG.15D WSL1
FIG.15E WSL2
FIG.15F WSL3
FIG.15G WSL4
FIG.15H WSL241
FIG.15I WSL242
FIG.15J WSL243
FIG.15K WSL244
FIG.15L DSL1
FIG.15M DSL2
FIG.15N DSL3
FIG.15O DSL4
FIG.15P DSL241
FIG.15Q DSL242
FIG.15R DSL243
FIG.15S DSL244

HSEL
103
PIXEL ARRAY SECTION (480 x n)
101
DTLn
DTL2
DTL1
SLCT0
SLCT1
107
DECODER
SLCT11
SLCT10
SLCT01
SLCT00
SLCTL11
SLCTL10
SLCTL01
SLCTL00
104a
VSCN
SCLK
CLK
WSL1
DSL1
WSL2
DSL2
WSL121
DSL121
WSL122
DSL122
WSL241
DSL241
WSL242
DSL242
WSL361
DSL361
WSL362
DSL362
1042
1043a
LOGIC CIRCUIT
L1
L2
L121
L122
L241
L242
L361
L362
SHIFT REGISTER
SR1
SR2
SR121
SR122
SR241
SR242
SR361
SR362
(1,n)
(2,n)
(121,n)
(122,n)
(241,n)
(242,n)
(361,n)
(362,n)
(1,2)
(2,2)
(121,2)
(122,2)
(241,2)
(242,2)
(361,2)
(362,2)
(1,1)
(2,1)
(121,1)
(122,1)
(241,1)
(242,1)
(361,1)
(362,1)
REGION REG1 (1ST TO 120TH STAGES)
REGION REG2 (121ST TO 240TH STAGES)
REGION REG3 (241ST TO 360TH STAGES)
REGION REG4 (361ST TO 480TH STAGES)

ONE FIELD PERIOD
CLK1
SCLK
SLCT0
SLCT1
SCLT00
SCLT01
SCLT10
SCLT11
WSL1
WSL2
WSL121
WSL122
WSL241
WSL242
WSL361
WSL362
DSL1
DSL2
DSL121
DSL122
DSL241
DSL242
DSL361
DSL362

DISPLAY APPARATUS AND DRIVING METHOD THEREFOR

CROSS REFERENCES TO RELATED APPLICATIONS

The present invention contains subject matter related to Japanese Patent Application JP 2007-092809, filed in the Japan Patent Office on Mar. 30, 2007, the entire contents of which are incorporated herein by reference.

BACKGROUND OF THE INVENTION

1. Field of the Invention

This invention relates to an active matrix type display apparatus from among display apparatus wherein pixel circuits are arrayed in a matrix, such as an organic electroluminescence (EL) display apparatus, and a driving method for the active matrix type display apparatus.

2. Description of the Related Art

In an image display apparatus such as, for example, a liquid crystal display (LCD) apparatus (hereinafter referred to as LCD apparatus), a large number of pixels are arrayed in a matrix and the intensity of light is controlled for each pixel in response to image information to be displayed to display an image.

Meanwhile, an organic EL display apparatus is a display apparatus of the self luminous display apparatus wherein each pixel circuit includes a light emitting device. The organic EL display apparatus is advantageous when compared with the LCD apparatus in that it is high in visual observability of a display image, no backlight is required and the response speed is high.

Further, the luminance of each light emitting device is controlled with the value of current flowing through the light emitting device to obtain a gradation of color development. In other words, the organic EL display apparatus is much different in characteristic from the LCD apparatus in that the light emitting device is of the current controlled type.

A simple matrix type driving system and an active matrix type driving system are available as a driving system for an organic EL display similarly to an LCD apparatus. Although the former system is simple in structure, it is not suitable to implement a display apparatus of a large size and a high definition. Therefore, development of the latter active matrix type driving system wherein an active device provided in the inside of each pixel circuit, usually a thin film transistor (TFT), is used for control is proceeding energetically.

Here, a principle of operation of a typical active matrix type organic EL display apparatus is described.

FIG. 1 shows a configuration of a typical organic EL display apparatus.

Referring to FIG. 1, the display apparatus 10 shown includes a pixel array section 12 wherein pixel circuits (PXLC) 12*a* are arrayed in a m×n matrix, a horizontal selector (HSEL) 13, a vertical scanner (VSCN) 14, data lines DTL1 to DTLn selected by the horizontal selector 13 that is supplied with a data signal according to luminance information, and scanning lines WSL1 to WSLm selectively driven by the vertical scanner 14.

It is to be noted that the horizontal selector 13 and/or the vertical scanner 14 may be formed on polycrystalline silicon or formed from a MOSIC or the like and formed around the pixels.

An example of a configuration of the pixel circuits 12*a* shown in FIG. 1 is shown in FIG. 2.

Referring to FIG. 2, a pixel circuit 20 has the simplest circuit configuration among various circuit configurations proposed heretofore.

The pixel circuit 20 includes a p-channel TFT 21, an n-channel TFT 22, a capacitor C21, and a light emitting device 23 formed from an organic EL device (OLED).

The TFT 21 of the pixel circuit 20 is connected at the base thereof to a power supply potential VDD and at the gate thereof to the drain of the TFT 22. The light emitting device 23 is connected at the anode thereof to the drain of the TFT 21 and at the cathode thereof to a reference potential GND, which may be, for example, the ground potential.

The TFT 22 of the pixel circuit 20 is connected at the source thereof to a data line DTL (DTL1 to DTLn) of a corresponding column and at the gate thereof to a scanning line WSL (WSL1 to WSLm) of a corresponding row. The capacitor C21 is connected at one terminal thereof to the power supply potential VDD and at the other terminal thereof to the drain of the TFT 22.

It is to be noted that, since an organic EL device in most cases has a rectification property, it is sometimes called an OLED (Organic Light Emitting Diode) and is represented using a symbol of a diode as a light emitting device in FIG. 2 and so forth. However, in the following description, the rectification property is not necessarily required for the OLED.

Where the pixel circuit 20 having such a configuration as described above is used, and when luminance data are to be written into such pixels, a pixel row including the pixels is selected through a corresponding scanning line WSL by the vertical scanner 14, and the TFT 22 in the pixels of the row is turned on.

At this time, the luminance data is supplied in the form of a voltage from the horizontal selector 13 through the data line DTL and written into the capacitor C21 for retaining a data voltage through the TFT 22.

The luminance data written in the capacitor C21 is retained for a period of one field. The retained data voltage is applied to the gate of the TFT 21.

Consequently, the TFT 21 drives the light emitting device 23 with electric current in accordance with the retained data. At this time, a gradation representation of the light emitting device 23 is carried out by modulating gate-source voltage Vdata (<0) of the TFT 21 retained by the capacitor C21.

It is to be noted that, since the TFT transistors used in the configuration example of FIG. 2 behave as switch devices, in the following description, the switch devices can be formed from a n-channel TFT, a p-channel TFT or any other switch device.

Generally, the luminance Loled of an organic EL device increases in proportion to the current Ioled flowing through the organic EL device. Accordingly, the luminance Loled and the current Ioled of the light emitting device 23 satisfy the following expression (1):

$$\text{Loled} \propto \text{Ioled} = k(V\text{data} - Vth) \quad (1)$$

where $k = \frac{1}{2} \cdot \mu \cdot Cox \cdot W/L$. Here, μ is the mobility of the carriers in the TFT 21, Cox the gate capacitance of the TFT 21 per unit area, W the gate width of the TFT 21, and L the gate length of the TFT 21.

Accordingly, the dispersion of the mobility μ and the threshold voltage Vth (<0) of the TFT 21 have a direct influence on the dispersion of the luminance of the light emitting devices 23.

In this instance, for example, even if the same potential Vdata is written into different pixels, the threshold voltage Vth of the TFT 21 disperses among the different pixels. Consequently, the current Ioled flowing through the light emitting device 23 disperses by a great amount among different pixels, and is displaced by a great amount from a desired value. As a result, a high picture quality cannot be expected with the display apparatus.

A large number of pixel circuits which solve the problem just described have been proposed, and a representative one of such pixel circuits is shown in FIG. 3.

Referring to FIG. 3, the pixel circuit 30 shown includes a p-channel TFT 31, n-channel TFTs 32 to 34, capacitors C31 and C32, and a light emitting device (OLED) 35 formed from an organic EL device. In FIG. 3, also, a data line DTL, a scanning line WSL, an auto zero line AZL and a driving line DSL are shown.

The operation of the pixel circuit 30 is described below with reference to FIGS. 4A to 4E.

The signal on the driving line DSL and the auto zero line AZL are set to the high level, as seen in FIGS. 4A and 4B, to place the TFT 32 and the TFT 33 into a conducting state, respectively. At this time, current flows through the TFT 31 because the TFT 31 is connected in a diode-connection state to the light emitting device 35.

Then, the signal on the driving line DSL is set to the low level to place the TFT 32 into a non-conducting state as seen in FIG. 4A. At this time, the scanning line WSL is placed into the high level state, as seen in FIG. 4C, to place the TFT 34 into a conducting state. Consequently, a reference potential Vref is applied to the data line DTL, as seen in FIG. 4D. Since the current flowing to the TFT 31 is interrupted thereby, the gate potential Vg of the TFT 31 rises, as seen in FIG. 4E. However, at a point in time at which the gate potential Vg rises to a potential of VDD−|Vth|, the TFT 31 enters a non-conducting state and the potential is stabilized. This operation is hereinafter referred to sometimes as an "auto zero operation".

Then, the auto zero line AZL is set to the low level to place the TFT 33 into a non-conducting state and the potential at the data line DTL is set to a potential lower than the reference potential Vref by a voltage AVdata. The variation of the signal line potential lowers the gate potential of the TFT 31 by a voltage AVg through a capacitor C31, as seen from FIG. 4E.

Then, if the scanning line WSL is set to the low level to place the TFT 34 into a non-conducting state and the driving line DSL is set to the high level to place the TFT 32 into a conducting state, as seen in FIGS. 4A and 4C, respectively, then current flows through the TFT 31 and the light emitting device 35. Consequently, the light emitting device 35 begins to emit light.

If the parasitic capacitance can be ignored, then the voltage ΔVg and the gate potential Vg of the TFT 31 are determined in accordance with the following expression (2) and (3), respectively:

$$\Delta Vg = \Delta V\text{data} \times C1/(C1+C2) \tag{2}$$

$$Vg = VCC - |Vth| - \Delta V\text{data} \times C1/(C1+C2) \tag{3}$$

where C1 is the capacitance value of the capacitor C31, and C2 the capacitance value of a capacitor C32.

On the other hand, where the current flowing through the light emitting device 35 upon light emission is represented by Ioled, the current Ioled is controlled by the TFT 31 connected in series to the light emitting device 35. If it is assumed that the TFT 31 operates in a saturation region, then a relationship given by the following expression (4) can be obtained using a well-known expression of the MOS transistor and the expression (3) above:

$$\begin{aligned} Ioled &= \mu CoxW/L/2\,(VCC - Vg - |Vth|)\,2 \\ &= \mu CoxW/L/2\,(\Delta Vdata \times C1/(C1+C2))\,2 \end{aligned} \tag{4}$$

where μ is the mobility of the carrier, Cox the gate capacitance per unit area, W the gate width, and L the gate length.

According to the expression (4), the current Ioled is controlled with the potential ΔVdata provided from the outside independently of the threshold voltage Vth of the TFT 31. In other words, if the pixel circuit 30 of FIG. 3 is used, then a display apparatus which is comparatively high in uniformity of the current, and hence in uniformity of the luminance without being influenced by the threshold voltage Vth which disperses among different pixels can be implement.

The pixel circuit described above is disclosed, for example, in U.S. Pat. No. 5,684,365, Japanese Patent Laid-Open No. Hei 8-234683 or JP-2002-514320T.

SUMMARY OF THE INVENTION

Although the particular example described above is an example of a solution to the elimination of the non-uniformity of luminance by the dispersion in TFT characteristic, as can be recognized even from a reference to FIG. 3 or 4, generally, a plurality of control signal lines, such as the scanning line WSL and the driving line DSL, are required in order to control one pixel circuit.

Now, a driving method for a pixel circuit in a typical active matrix type organic EL display apparatus is described. For a simplified description, a driving method wherein a scanning signal propagated along a scanning line WSL to control writing into pixel circuits and a driving signal propagated along a driving line DSL to control light emitting devices 35 are used is described.

FIG. 5 shows a display apparatus 10*a* in the form of an active matrix type organic EL display apparatus. Referring to FIG. 5, the display apparatus 10*a* includes pixel circuits 30, a horizontal selector (HSEL) 13, a vertical scanner (VSCN) 14 and a drive scanner (DSCN) 15. Such pixel circuits 30, as shown in FIG. 3, are arrayed in a 480×n matrix in a pixel array section. The pixel circuits 30 are individually connected to the horizontal selector 13 by data lines DTL1 to DTLn, the vertical scanner 14 by scanning lines WSL1 to WSL480, and the drive scanner 15 through driving lines DSL1 to DSL480.

The vertical scanner 14, the drive scanner 15, and the horizontal selector 13 successively drive the scanning lines WSL1 to WSL480, driving lines DSL1 to DSL480 and data lines DTL1 to DTLn in accordance with a clock signal to select a predetermined pixel circuit 30 and carry out writing into the selected pixel circuit 30.

The vertical scanner 14 includes shift registers SRW1 to SRW480 and logic circuits LW1 to LW480 for 480 stages therein. The shift registers SRW1 to SRW480 are connected in series, and the logic circuits LW1 to LW480 are connected to the shift registers SRW1 to SRW480 for the individual stages, respectively.

A start signal SCLK1 of a period equal to that for writing into the pixel circuits 30 is inputted to the shift register SRW1 at the first stage. Further, clock signals CLK1 of the same period are inputted in parallel to the shift registers SRW1 to SRW480.

The shift registers SRW1 to SRW480 individually output an input signal to the logic circuits LW1 to LW480, each formed from a plurality of devices, and the logic circuits LW1 to LW480 carry out a predetermined process for the input signal so that scanning signals are propagated along the scanning lines WSL1 to WSL480.

The drive scanner 15 has shift registers SRD1 to SRD480 and logic circuits LD1 to LD480 for 480 stages provided therein. The shift registers SRD1 to SRD480 are connected in series, and the logic circuits LD1 to LD480 are connected to the shift registers SRW1 to SRW480 for the individual stages, respectively.

To the shift register SRD1 at the first stage, a start signal SCLK2 of a period equal to that of the driving signal for controlling the TFT 32 of the pixel circuit 30 is inputted. Further, clock signals CLK2 of the same period are inputted in parallel to the shift registers SRD1 to SRD480.

The shift registers SRD1 to SRD480 output an input signal to the logic circuits LD1 to LD480, each formed from a plurality of devices, and the logic circuits LD1 to LD480 carry out a predetermined process for the input signal so that driving signals are propagated along the driving lines DSL1 to DSL480, respectively.

A set of shift registers are provided for one scanning signal outputted from the vertical scanner 14, and similarly a set of shift registers are provided for one driving signal outputted from the drive scanner 15. However, general active matrix type organic EL display apparatuses also have a similar configuration.

Now, the operation of the vertical scanner 14 and the drive scanner 15 is described with reference to FIGS. 6A to 6T.

FIGS. 6A to 6T illustrates the operation of the vertical scanner 14 and the drive scanner 15 in the display apparatus 10*a*. In particular, FIG. 6A illustrates the clock signal CLK1; FIG. 6B illustrates the start signal SCLK1; FIGS. 6C to 6J illustrate scanning signals propagated along the scanning lines WSL1 to WSL244; FIG. 6K illustrates the clock signal CLK2; FIG. 6L illustrates the start signal SCLK2; and FIGS. 6M to 6T represent driving signals propagated along the driving lines DSL1 to DSL244, respectively. It is to be noted that the scanning signals and the driving signals illustrated in FIGS. 6C to 6T illustrate only parts thereof.

It is assumed that, as seen in FIGS. 6C to 6J, an on/off scanning signal is propagated once along the scanning lines WSL1 to WSL480 within a period of one field, and as seen in FIGS. 6M to 6T, an on/off driving signal is propagated twice within a period of one field. It is to be noted that the scanning lines WSL and the driving lines DSL illustrated in FIGS. 6C to 6T illustrate only part of the signal lines. Further, it is assumed that, in an initial state, input and output signals of all shift registers SRW are set to the low level.

The clock signal CLK1 is inputted to the shift registers SRW1 to SRW480 of the vertical scanner 14, as seen in FIG. 6A, and the clock signal CLK2 is inputted to the shift registers SRD1 to SRD480 of the drive scanner 15, as seen in FIG. 6K.

Meanwhile, the start signal SCLK1 is inputted to the shift register SRW1 at the first stage, as seen in FIG. 6B, and the start signal SCLK2 is inputted to the shift register SRD1 at the first stage, as seen in FIG. 6L.

It is to be noted that the clock signals CLK1 and CLK2 of 480 pulses are inputted to the shift registers SRW1 to SRW480 and shift registers SRD1 to SRD480 within a period of one field, respectively.

The start signal SCLK1 inputted to the shift register SRW1 at the first stage is successively shifted to the shift registers SRW2 to SRW480 in synchronism with the clock signal CLK1. Then, the shift registers SRW1 to SRW480 successively propagate a scanning signal to the scanning lines WSL1 to WSL480 through the logic circuits LW1 to LW480, as seen in FIGS. 6C to 6J, respectively, to control the TFT 34 (refer to FIG. 3) of the pixel circuits 30.

Also, the drive scanner 15 operates similarly to the vertical scanner 14 and successively propagates a driving signal to the driving lines DSL1 to DSL480, as seen in FIGS. 6M to 6T, to control the TFT 32 (refer to FIG. 3) of the pixel circuits 30 similarly as in the operation of the vertical scanner 14.

Incidentally, an active matrix type organic EL display apparatus includes a number of driving signal lines which is greater than that in a general active matrix type LCD apparatus which requires only one scanning line for one pixel circuit. Further, the active matrix type organic EL display apparatus has an increased size of peripheral elements of a circuit for production of driving signals, because a greater number of driving signal lines are required, and since the driving signal lines are produced using TFTs on a glass substrate, a framework of an increased size is required for the display apparatus. This gives rise to a problem that the power consumption is increased thereby.

One of solutions to the problem described above is to use a set of shift registers for one pixel to produce a plurality of output signals of different drive circuits.

Now, an example of the solutions to the problem described above is described with reference to FIGS. 7 and 8A to 8R.

FIG. 7 shows an example of a display apparatus 10*b* according to the solution example to the problem.

Referring to FIG. 7, the display apparatus 10*b* is configured so as to use a set of shift registers and a logic circuit to carry out writing into a pixel. A vertical scanner 14*a* has a configuration similar to that of the vertical scanner 14 of FIG. 5 and includes shift registers SR1 to SR480 and logic circuits L1 to L480 for individual rows of pixel circuits 30. The logic circuits L1 to L480 are connected to the pixel circuits 30 for individual rows through the scanning lines WSL1 to WSL480 and the driving lines DSL1 to DSL480, respectively.

Now, the operation of the vertical scanner 14*a* is described with reference to FIGS. 8A to 8R.

FIGS. 8A to 8R are timing charts illustrating the operation of the vertical scanner 14*a* in the display apparatus 10*b*. FIG. 8A illustrates the clock signal CLK; FIG. 8B illustrates the start signal SCLK; FIGS. 8C to 8J illustrate scanning signals propagated along the scanning lines WSL1 to WSL244; and FIGS. 8K to 8R illustrate driving signals propagated along the driving lines DSL1 to DSL244. It is to be noted that the signals on the scanning lines and the driving lines are illustrated at only a part thereof.

As seen in FIGS. 8C to 8J, an on/off scanning signal and a driving signal are propagated once within a period of one field along the scanning lines WSL1 to WSL480 and the driving lines DSL1 to DSL480.

It is to be noted that it is assumed that, in an initial state, the inputs and outputs of all of the shift registers SRW are set to the low level. Further, the clock signal CLK of 480 pulses is inputted to the shift registers SR1 to SR480 within a period of one field.

In the vertical scanner 14*a* shown in FIG. 7, the clock signal CLK is inputted to the shift registers SR1 to SR480 of the vertical scanner 14*a* (FIG. 8A) and the start signal SCLK is inputted to the shift register SR1 at the first stage (FIG. 8B) similarly as in the vertical scanner 14 of the display apparatus 10*a* described hereinabove.

The start signal SCLK inputted to the shift register SR1 at the first stage is successively shifted to the shift registers SR2 to SR480 in synchronism with the clock signal CLK1.

Then, the shift registers SR1 to SR480 successively propagate an input signal to the scanning lines WSL1 to WSL480, as seen in FIGS. 8C to 8J, through the logic circuits L1 to L480 to control the TFT 34 (refer to FIG. 3) of the pixel circuits 30.

If a signal delayed by one half clock is used for the driving signal, then the TFT 32 of the pixel circuits 30 can be controlled, for example, using the scanning signal of the scanning line WSL2 as a driving signal for the driving line DSL1, as seen in FIG. 8K.

If the number of an arbitrary shift stage of a shift register is represented by i, then the driving signal propagated along the driving line DSL(i) is equal to the scanning signal propagated to the scanning line WSL(i+1), and a plurality of driving signals can be outputted from one set of shift registers.

However, although the method described above can be used if the on/off periods of signals propagated along a scanning line WSL and a driving line DSL are the same, where such a plurality of scanner signals as seen in FIGS. 6C to 6J are used and different operations having different on/off periods are carried out for the individual scanner signals, desired scanner signals cannot be produced. Therefore, the method described above cannot be used as it is.

Therefore, it is demanded to provide a display apparatus and a driving method therefor by which shift registers can be used commonly for a plurality of scanner signals having different periods from each other while the shift registers are scanned with the same clock.

According to an embodiment of the present invention, there is provided a display apparatus including a plurality of pixel circuits, each having a plurality of switches configured to receive a driving signal of a predetermined period that is to be controlled for an opening and closing operation by the driving signal, and a drive circuit configured to control the open/closed state of the switches, the drive circuit being operable to scan the pixel circuits and open and close the switches in periods independent of each other.

Preferably, the drive circuit is divided into a desired plural number of regions for the pixel circuits in the scanning direction, and selects only a desired one of the divisional regions with a select signal and controls the open/closed state of the switches in the selected divisional region.

In this instance, preferably, the display apparatus is configured such that each of the pixel circuits includes a first switch connected to a first driving line controlled in a first period, and a second switch connected to a second driving line controlled in a second period, and the drive circuit including a plurality of shift registers connected in series. Each of the shift registers has a first input to which a clock signal of a predetermined period is inputted and a second input, with one of the shift registers which is at a first stage receiving a signal of a predetermined period at the second input thereof, and the drive circuit being configured to successively select the divisional regions with the select signal and control the first and second switches in the first and second periods in response to input and output states of the shift registers.

Preferably, the display apparatus is configured such that each of the pixel circuits includes an electro-optical device, a drive transistor configured to drive the electro-optical device with a write signal to emit light, a first switch configured to be opened and closed with a first scanning signal, and a second switch configured to be opened and closed with the second scanning signal to supply the write signal to a control terminal for the drive signal, and the drive circuit being configured to set the second opening and closing period longer than the opening and closing period of the first switch and drive the second switch in the second opening and closing period.

According to another embodiment of the present invention, there is provided a driving method for a display apparatus which includes a plurality of pixel circuits, each including a plurality of switches configured to receive a driving signal of a predetermined period and to be controlled for an opening and closing operation by the driving signal, including a step of scanning the pixel circuits in the predetermined period and controlling the switches individually in periods independent of each other.

In the display apparatus and the driving method therefor, the plural switches of each pixel circuit receive driving signals from the drive circuit and are controlled so as to be opened and closed with the driving signals. At this time, the switches are controlled so as to be opened and closed in the periods independent of each other.

With the display apparatus and the driving method therefor, since the shift registers can be shared among a plurality of scanning signals having different periods from each other, a reduction in size of the framework can be implemented.

BRIEF DESCRIPTION OF THE DRAWINGS

FIG. 13 is a block diagram showing an example of an equivalent model of a shift register shown in FIG. 11;

FIGS. 14A to 14D are timing charts illustrating the operation of the shift register of FIG. 13;

FIGS. 15A to 15S are timing charts illustrating the operation of the vertical scanner of FIG. 12;

DETAILED DESCRIPTION OF THE PREFERRED EMBODIMENT

A preferred embodiment of the present invention is explained by referring to diagrams as follows.

Figure 1:
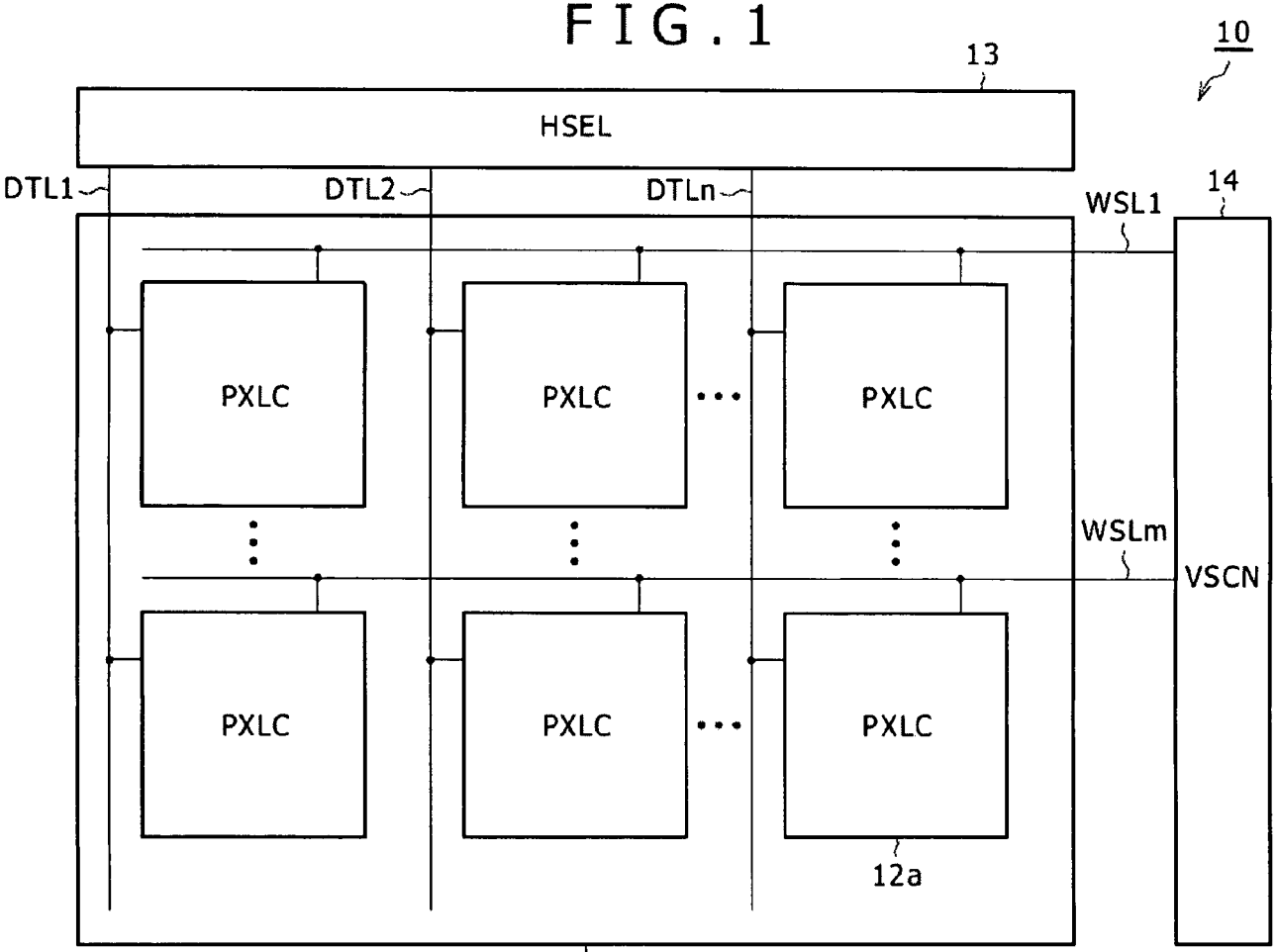
FIG. 1 is a block diagram showing a configuration of a typical organic EL display apparatus.
Figure 2:
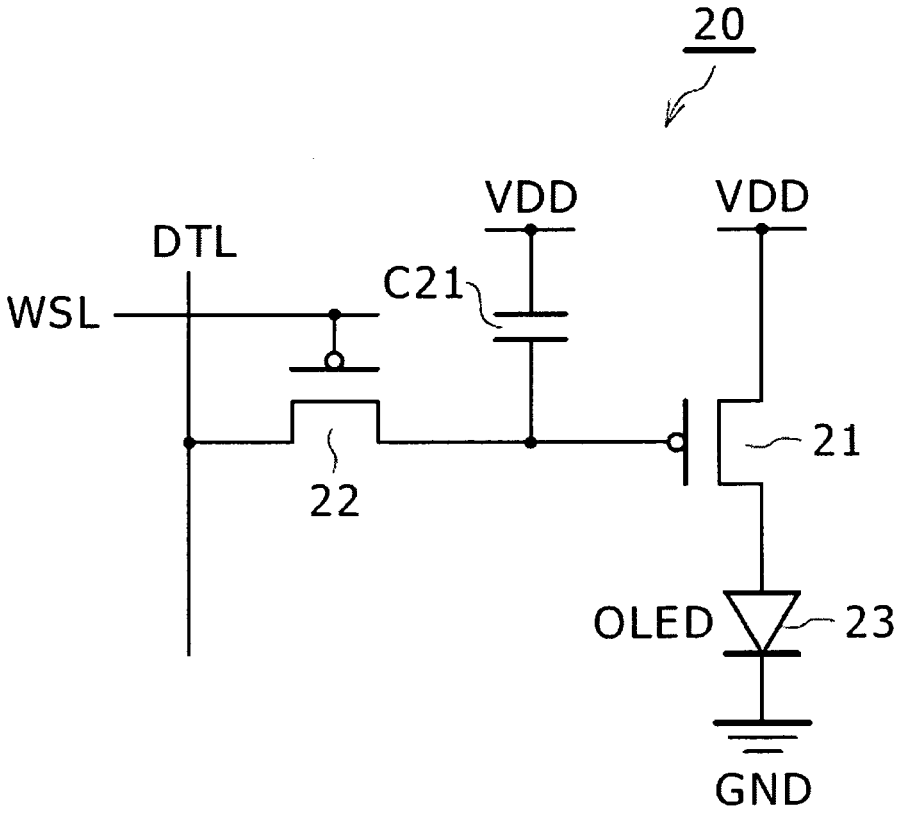
FIG. 2 is a circuit diagram showing a first example of a configuration of a pixel circuit shown in FIG. 1.
Figure 3:
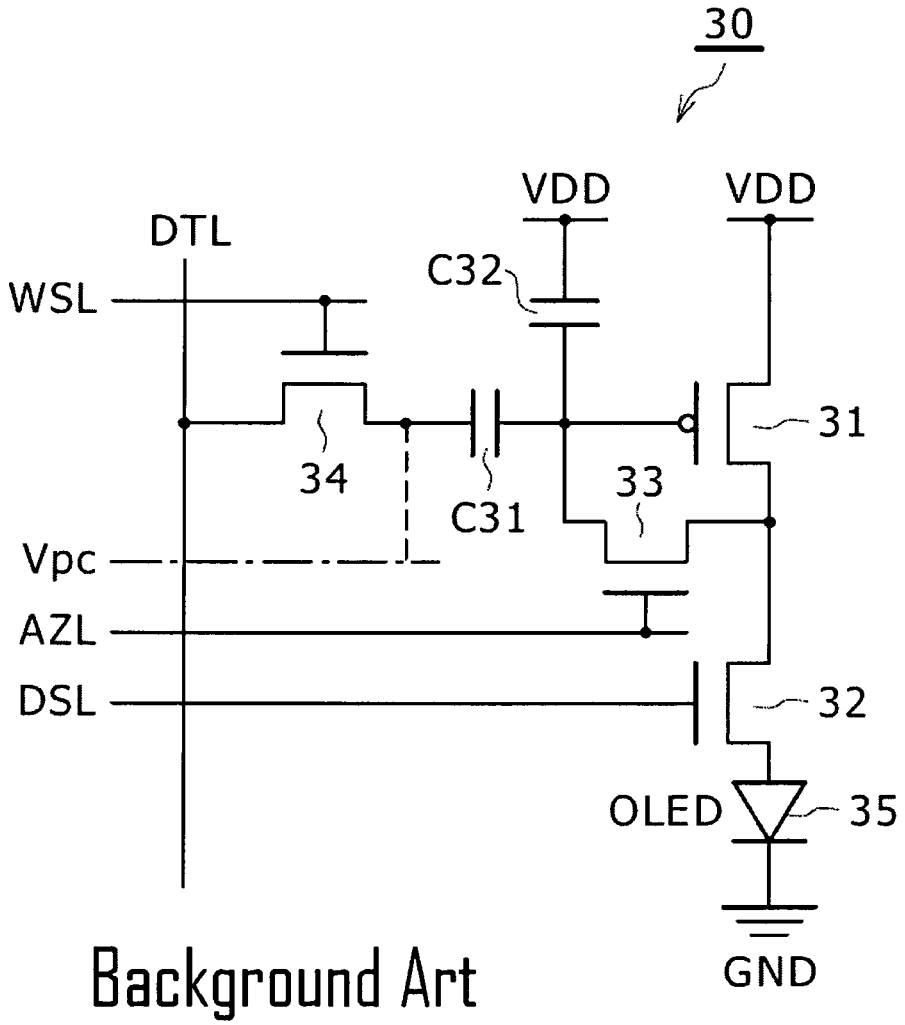
FIG. 3 is a circuit diagram showing a second example of a configuration of the pixel circuit shown in FIG. 1.
Figures 4A, 4B, 4C, 4D, 4E:
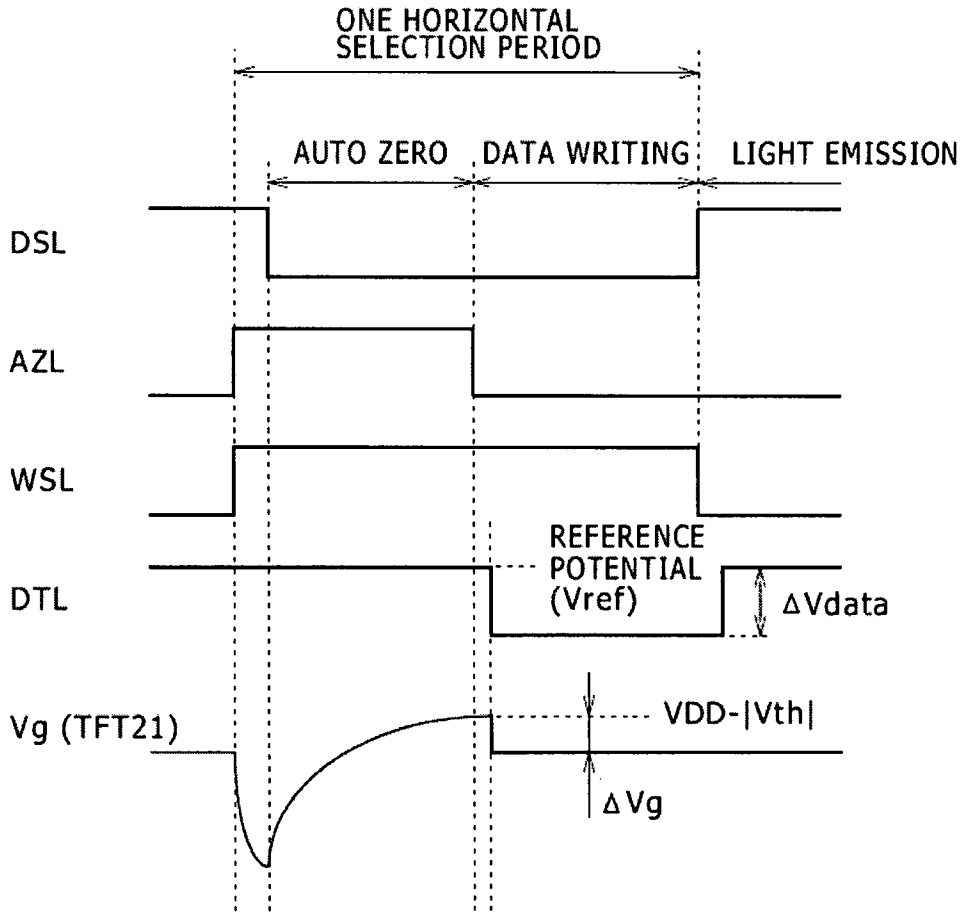
FIG.4E Background Art
FIGS. 4A to 4E are timing charts illustrating a driving method for the pixel circuit of FIG. 3.
Figure 5:
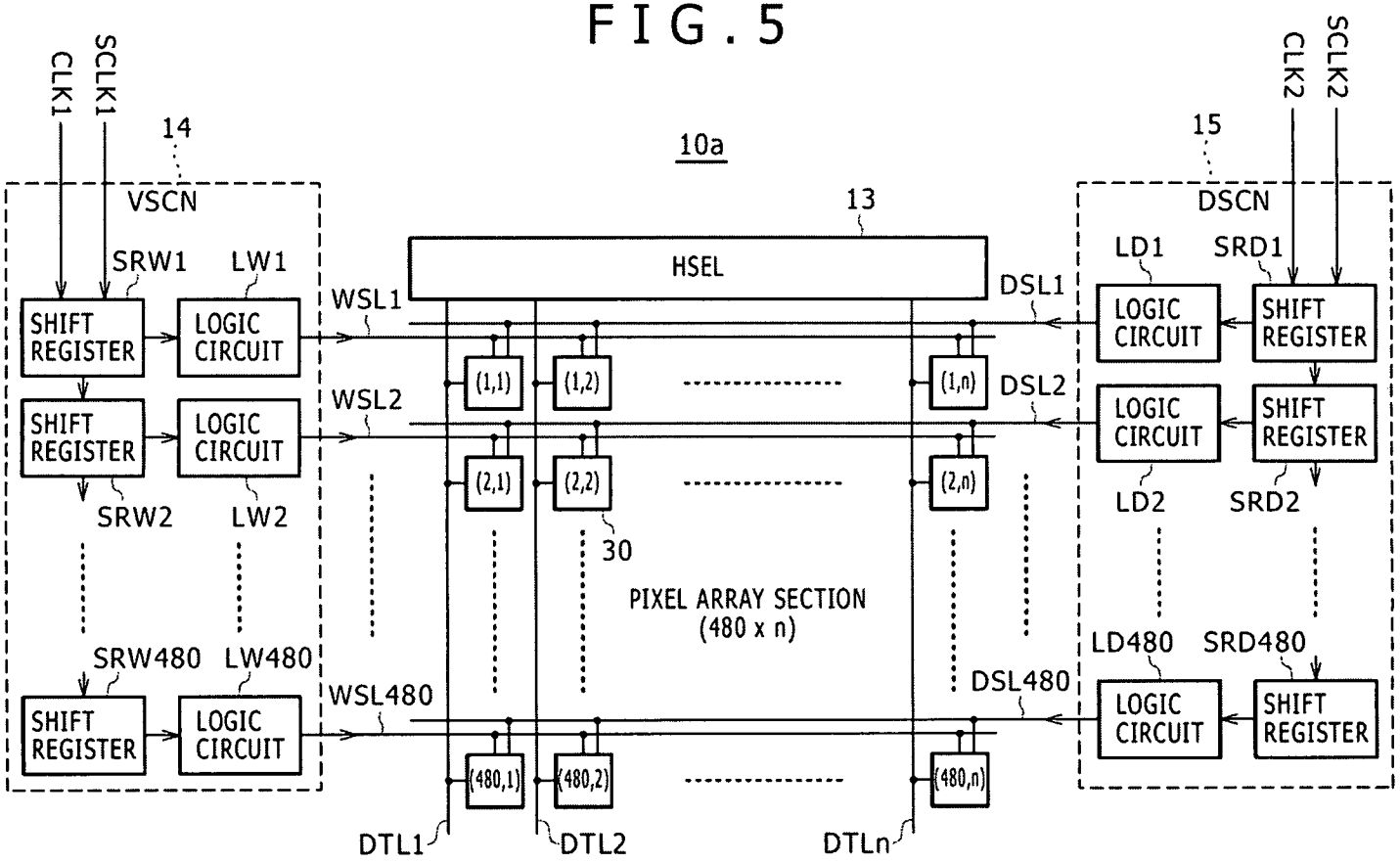
FIG. 5 is a block diagram showing an example of a configuration of a different, typical, organic EL display apparatus and a vertical scanner.
Figure 6:
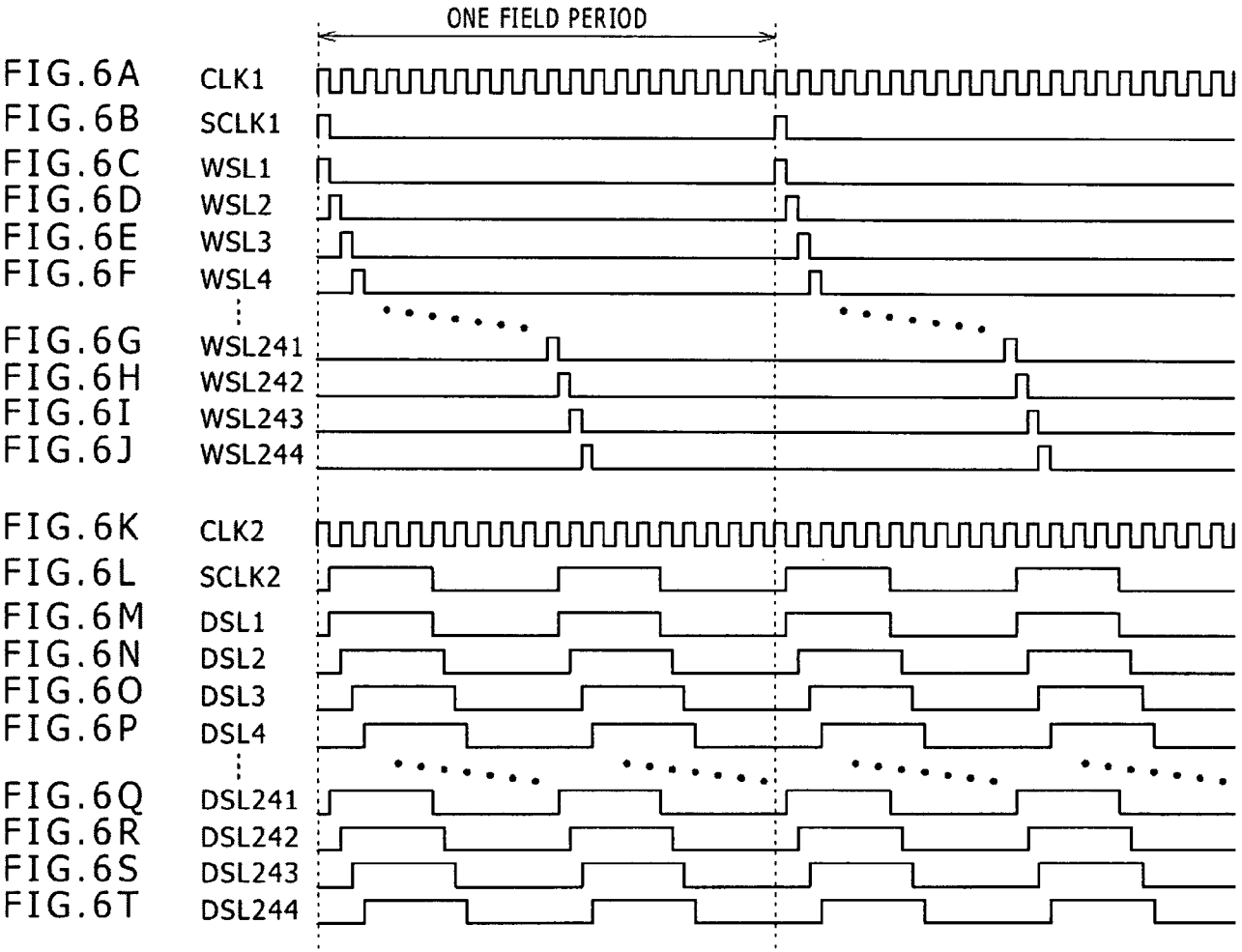
FIGS. 6A to 6T are timing charts illustrating the operation of the vertical scanner shown in FIG. 5.
Figure 7:
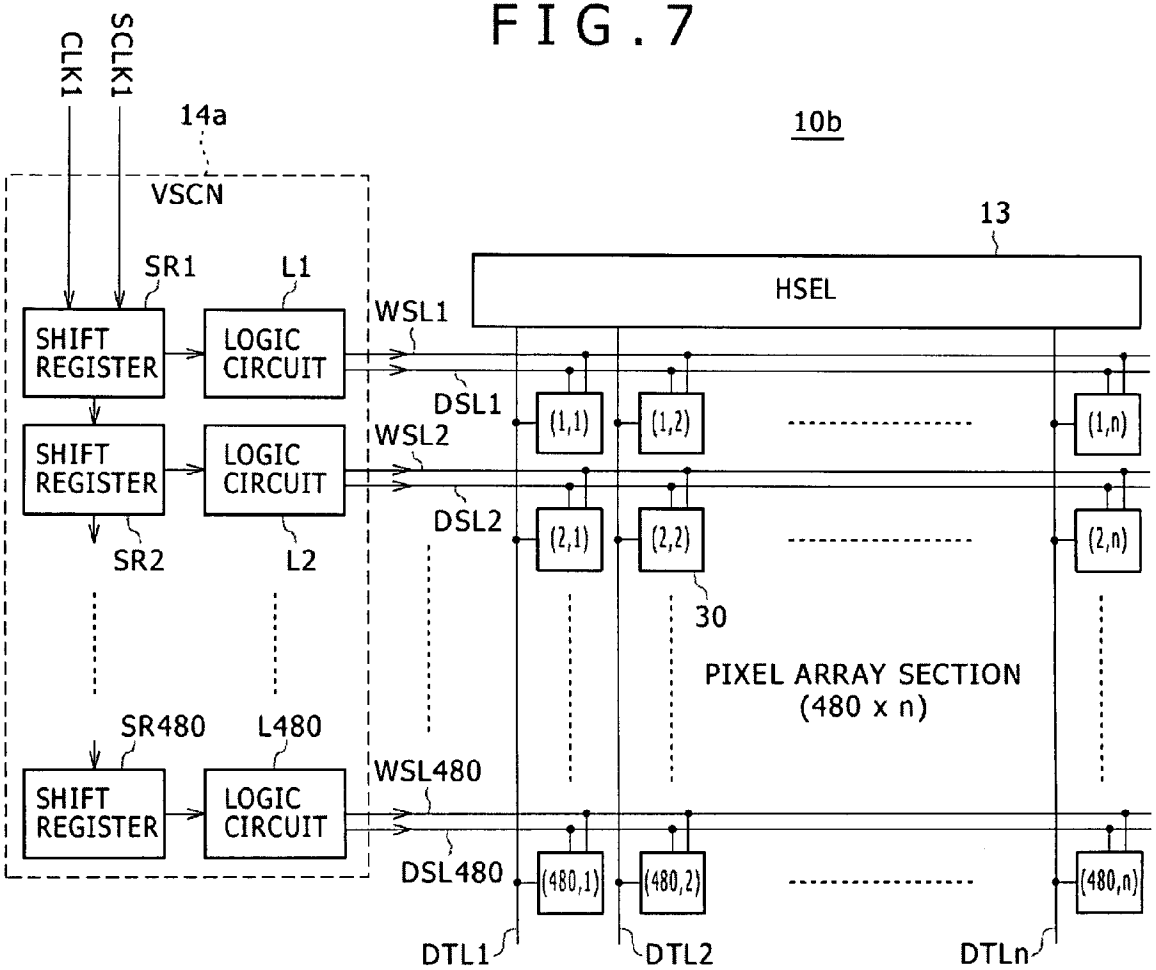
FIG. 7 is a block diagram showing another example of a configuration of the different, typical, organic EL display apparatus and the vertical scanner.
Figure 8:
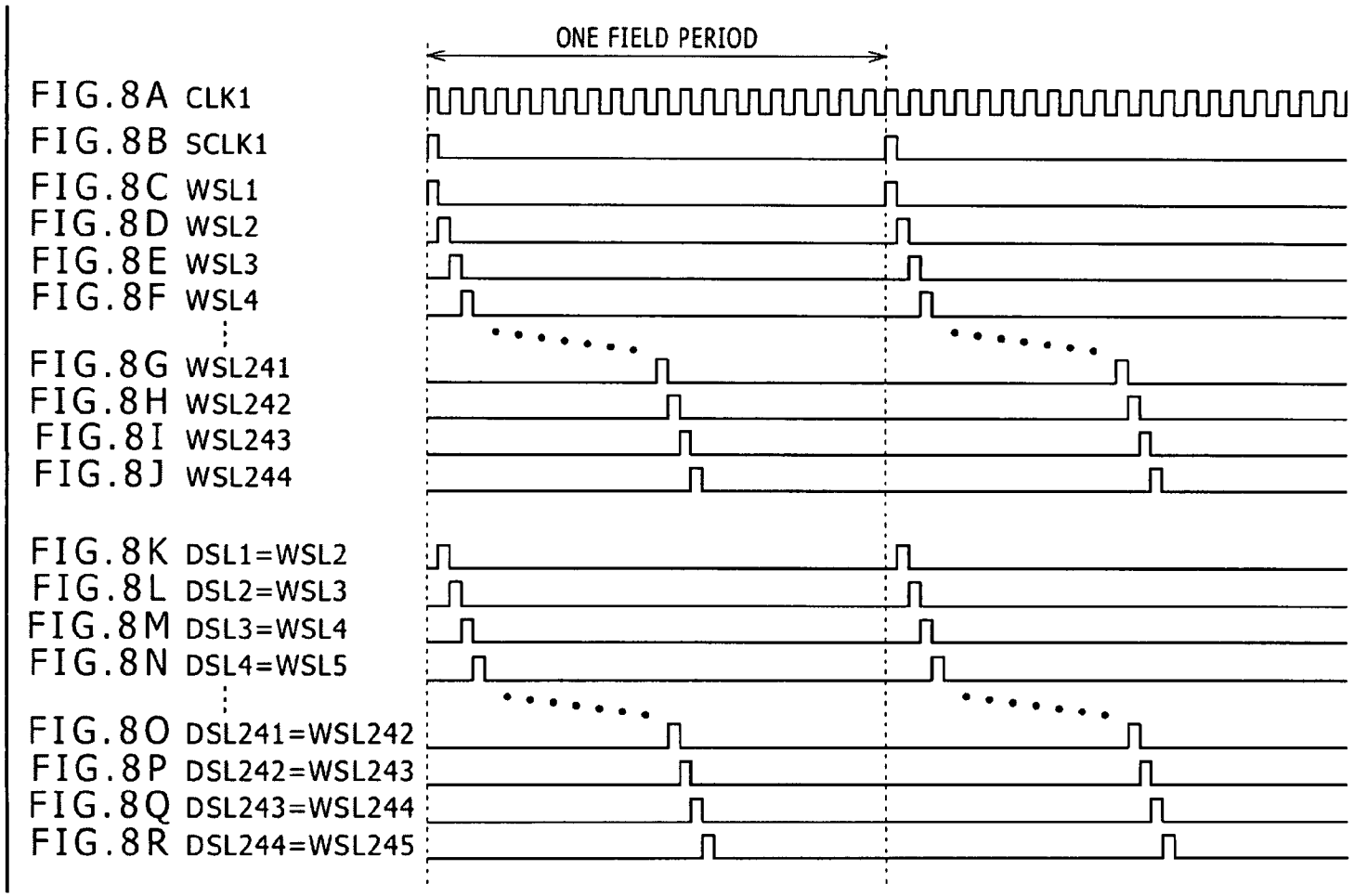
FIGS. 8A to 8R are timing charts illustrating the operation of the vertical scanner shown in FIG. 7.
Figure 9:
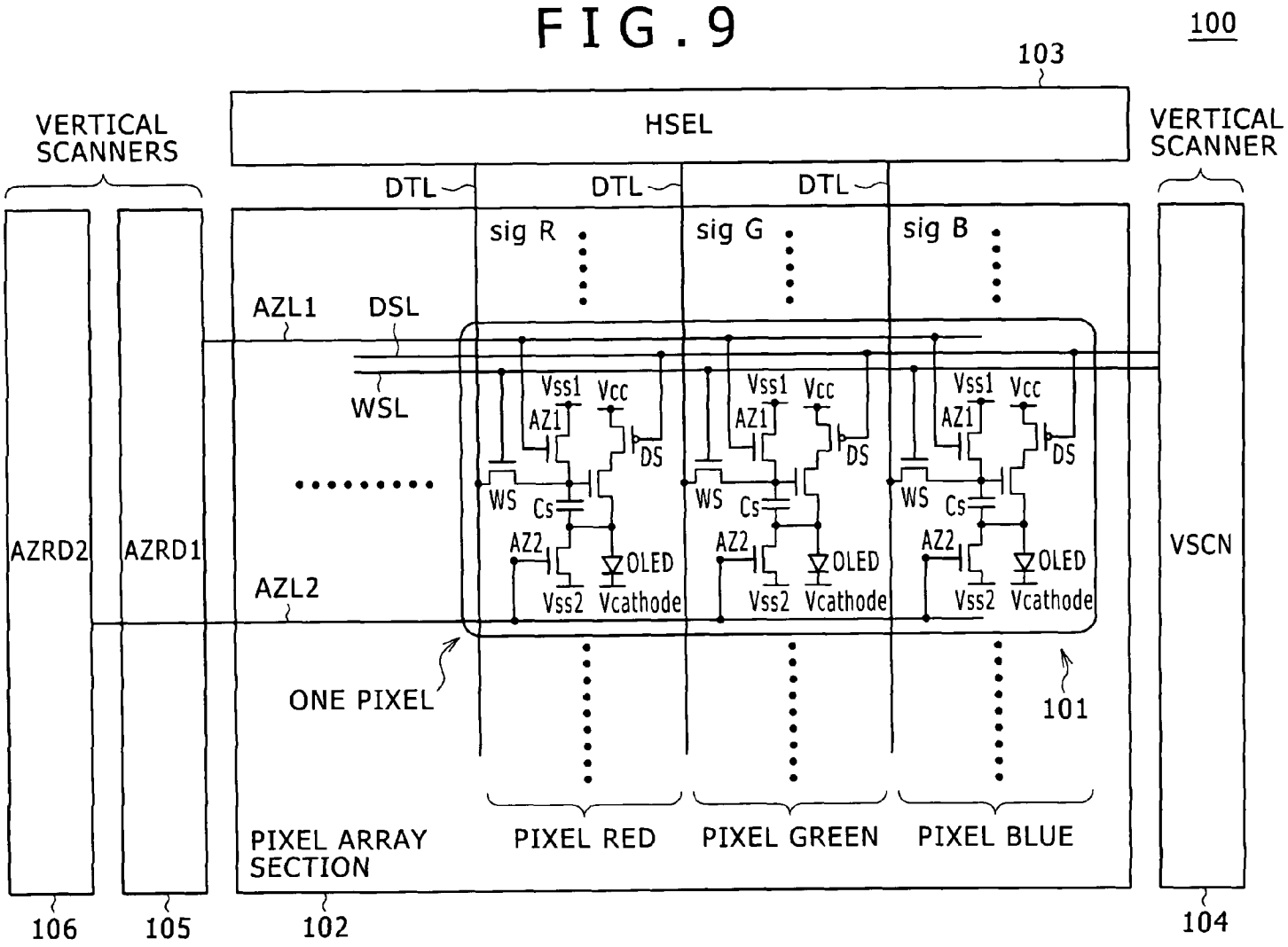
FIG. 9 is a block diagram showing an example of a configuration of an organic EL display apparatus to which an embodiment of the present invention is applied.
Figure 10:
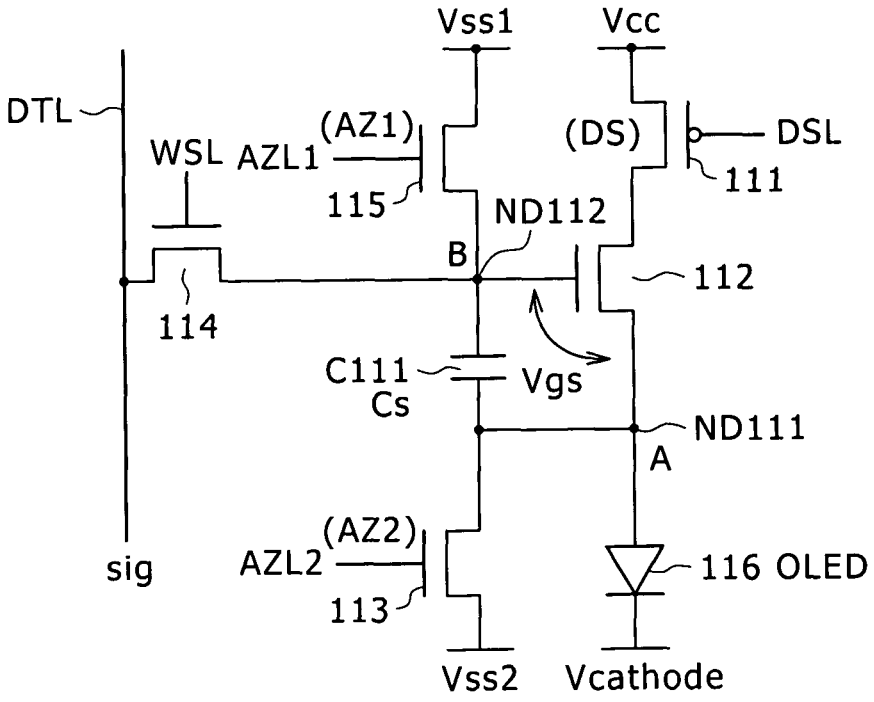
FIG. 10 is a circuit diagram showing an example of a configuration of a pixel circuit shown in FIG. 9.

FIG. 9 shows an example of a configuration of an organic EL display apparatus to which the present invention is applied, and FIG. 10 shows an example of a particular configuration of a pixel circuit employed in the organic EL display apparatus.

Referring to FIGS. 9 and 10, the display apparatus 100 includes a pixel array section 102 wherein pixel circuits 101 are arrayed in a m×n matrix, a horizontal selector (HSEL) 103, a vertical scanner (VSCN) 104 serving as a drive circuit, a first auto zero circuit (AZRD1) 105 and a second auto zero circuit (AZRD2) 106.

Each of the pixel circuits 101 is connected to the horizontal selector 103 by a data line DTL and connected to the vertical scanner 104 by a scanning line WSL for controlling writing into the pixel circuits 101 and a driving line DSL for driving a light emitting device. Further, each pixel circuit 101 is connected to the first auto zero circuit 105 by a first auto zero line AZL1 serving as a third driving line and connected to the second auto zero circuit 106 by a second auto zero line AZL2 serving as a fourth driving line.

In the following description, it is assumed that the pixel array section 102 includes pixel circuits 101 arrayed in a 480 (=m)×n matrix.

Each of the pixel circuits 101 includes a p-channel TFT 111 which corresponds to a second switch, n-channel TFTs 112 and 113, a further n-channel TFT 114 which corresponds to a first switch, a still further n-channel TFT 115, a capacitor C111, a light emitting device 116 formed from an organic EL device, a first node ND111 and a second node ND112.

In the pixel circuit 101, the TFT 111, the TFT 112 serving as a driving transistor, the first node ND111 and the light emitting device 116 are all connected in series between the first reference voltage, power supply potential VCC, and the second reference potential, the ground potential Vcathode, which are in the present embodiment. More particularly, the light emitting device 116 is connected at the cathode thereof to the ground potential Vcathode and at the anode thereof to the first node ND111. The TFT 112 is connected at the source thereof to the first node ND111, the TFT 111 is connected at the drain thereof to the drain of the TFT 112, and the TFT 111 is connected at the source thereof to the power supply potential VCC.

The TFT 112 is connected at the gate thereof to the second node ND112, and the TFT 111 is connected at the gate thereof to a driving line DSL. The TFT 113 is connected at the drain thereof to the first node ND111 and the first electrode of the capacitor C111 and at the source thereof is fixed at the potential VSS2. Further, the TFT 113 is connected at the gate thereof to a second auto zero line AZL2. Further, the capacitor C111 is connected at a second electrode thereof to the second node ND112.

The source and the drain of the TFT 114 are connected to and between the data line DTL and the second node ND112. The TFT 114 is connected at the gate thereof to a scanning line WSL. Further, the source and the drain of the TFT 115 are connected to and between the second node ND112 and a predetermined potential Vssl. The TFT 115 is connected at the gate thereof to a first auto zero line AZL1.

When a scanning signal propagated along the scanning line WSL has a high level, the TFT 114 exhibits an on state and writing into the pixel is carried out.

On the other hand, when the driving signal propagated along the driving line DSL has a low level, the TFT 111 exhibits an on state and current flows to the light emitting device 116 so that the light emitting device 116 emits light.

Now, a first example of a configuration of the vertical scanner 104 is described.

FIRST CONFIGURATION EXAMPLE

Figure 11:
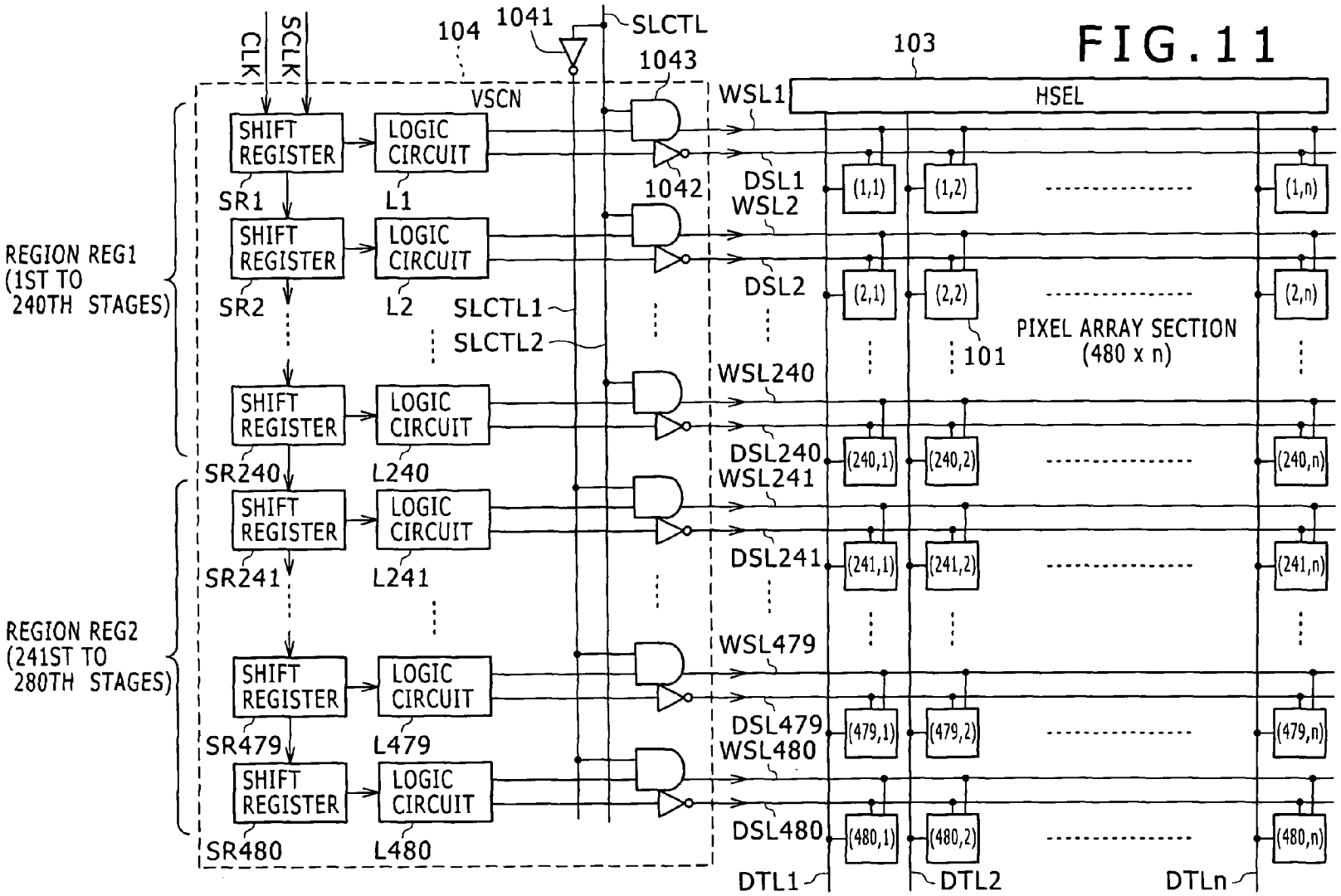
FIG. 11 is a block diagram showing a first example of a configuration of a vertical scanner shown in FIG. 9.

FIG. 11 shows the first configuration example of the vertical scanner 104.

The vertical scanner 104 of the display apparatus 100 shares shift registers for a plurality of signals having different periods while scanning the shift registers with the same clock. The following description is given focusing on the vertical scanner 104 for a simplified illustration and description. Therefore, a description of the first auto zero circuit 105, second auto zero circuit 106, first auto zero line AZL1, and second auto zero line AZL2 is omitted here.

The pixel circuits 101 are connected to the horizontal selector 103 by data lines DTL1 to DTLn and connected to the vertical scanner 104 by scanning lines WSL1 to WSL480 and driving lines DSL1 to DSL480.

The vertical scanner 104 includes shift registers SR1 to SR480 and logic circuits L1 to L480.

The shift registers SR1 to SR480 are connected in series and have the logic circuits L1 to L480 connected thereto for individual shift stages. Clock signals CLK of the same period are inputted to the shift registers SR1 to SR480, and a start signal SCLK having a driving period for the light emitting devices is inputted to the shift register SR1 at the first stage.

The vertical scanner 104 shown in FIG. 11 is divided into a first region REG1 including the shift registers SR1 to SR240 and the logic circuits L1 to L240 disposed on the first to 240th shift stages, respectively, and a second region REG2 including the shift registers SR241 to SR480 and the logic circuits L241 to L480 disposed on the 241st to 480th shift stages, respectively.

In the present configuration example, in order to change over between the first region REG1 and the second region REG2, the vertical scanner 104 includes a select signal line SLCTL, a first select signal line SLCTL1, a second select signal line SLCTL2, an inverter 1041, inverters 1042 for the 480 stages, and AND gates 1043 for the 480 stages.

As seen in FIG. 11, the select signal line SLCTL is distributed to the first select signal line SLCTL1 and the second select signal line SLCTL2. Further, the inverter 1041 is connected to the first select signal line SLCTL1 so as to invert a signal inputted to the vertical scanner 104.

First Region REG1

In the first region REG1, each of the logic circuits L1 to L240 is connected at a first output terminal thereof to a second input terminal of an AND gate 1043 and at a second output terminal thereof to an input terminal of an inverter 1042, each by a signal line. The AND gate 1043 is connected at a first input terminal thereof to the second select signal line SLCTL2 and at the second input terminal thereof to a first output terminal of one of the logic circuits L1 to L240 on the corresponding stage, each by a signal line, and connected at an output terminal thereof to the pixel circuit 101 on the same stage by a corresponding one of the scanning lines WSL1 to WSL240. The inverters 1042 are connected to the pixel circuits 101 of the same stages by the driving lines DSL1 to DSL240, respectively.

Second Region REG2

In the second region REG2, each of the logic circuits L241 to L480 is connected at a first output terminal thereof to a second input terminal of an AND gate 1043 and at a second output terminal thereof to an input terminal of an inverter 1042, each by a signal line. The AND gate 1043 is connected at a first input terminal thereof to the second select signal line SLCTL2 and at the second input terminal thereof to a first output terminal of one of the logic circuits L241 to L480 on the corresponding stage, each by a signal line. Further, the AND gate 1043 is connected at an output terminal thereof to those of the pixel circuits 101 and one of the scanning lines WSL241 to WSL480 on the same stage. The inverters 1042 are connected to the pixel circuits 101 of the same stages by the driving lines DSL241 to DSL480.

Now, the selection of the regions REG1 and REG2 in the present configuration example is described.

Selection of the First Region REG1

If a select signal SLCT propagated to the select signal line SLCTL is changed over to the high level, then the signal level of the second select signal line SLCTL2 is hereafter held at the high level, and the signal level of the first select signal line SLCTL1 is changed over to the low level by the inverter 1041. Accordingly, the scanning lines WSL1 to WSL240 disposed in the first region REG1 are selected by the AND gates 1043, and writing is carried out only into those pixel circuits 101, which are connected to the scanning lines WSL1 to WSL240.

Selection of the Second Region REG1

If the select signal SLCT propagated to the select signal line SLCTL is changed over to the low level, then the signal level of the first select signal line SLCTL1 is changed over to the high level by the inverter 1041, and the signal level of the second select signal line SLCTL2 is changed over to the low level. Accordingly, the scanning lines WSL241 to WSL480 disposed in the second region REG2 are selected by the AND gates 1043, and writing is carried out only into those pixel circuits 101 that are connected to the scanning lines WSL241 to WSL480.

To the driving lines DSL1 to DSL480, output signals of the logic circuits L1 to L480 are propagated irrespective of the select signal SLCT. When any of the output signals has the high level, the signal level is inverted to the low level by the inverter 1042, and consequently, the TFT 111 (refer to FIG. 10) of the pixel circuits 101 connected to a corresponding one of the driving lines DSL1 to DSL480 is turned on and the light emitting device 116 emits light.

In short, if the select signal SLCT is kept at the high level, then writing into the pixel circuits 101 in the first region REG1 is enabled, but if the select signal SLCT is kept at the low level, then writing into the pixel circuits 101 in the second region REG2 is enabled.

Now, a circuit configuration of the vertical scanner 104 in the present configuration example is described.

Figure 12:
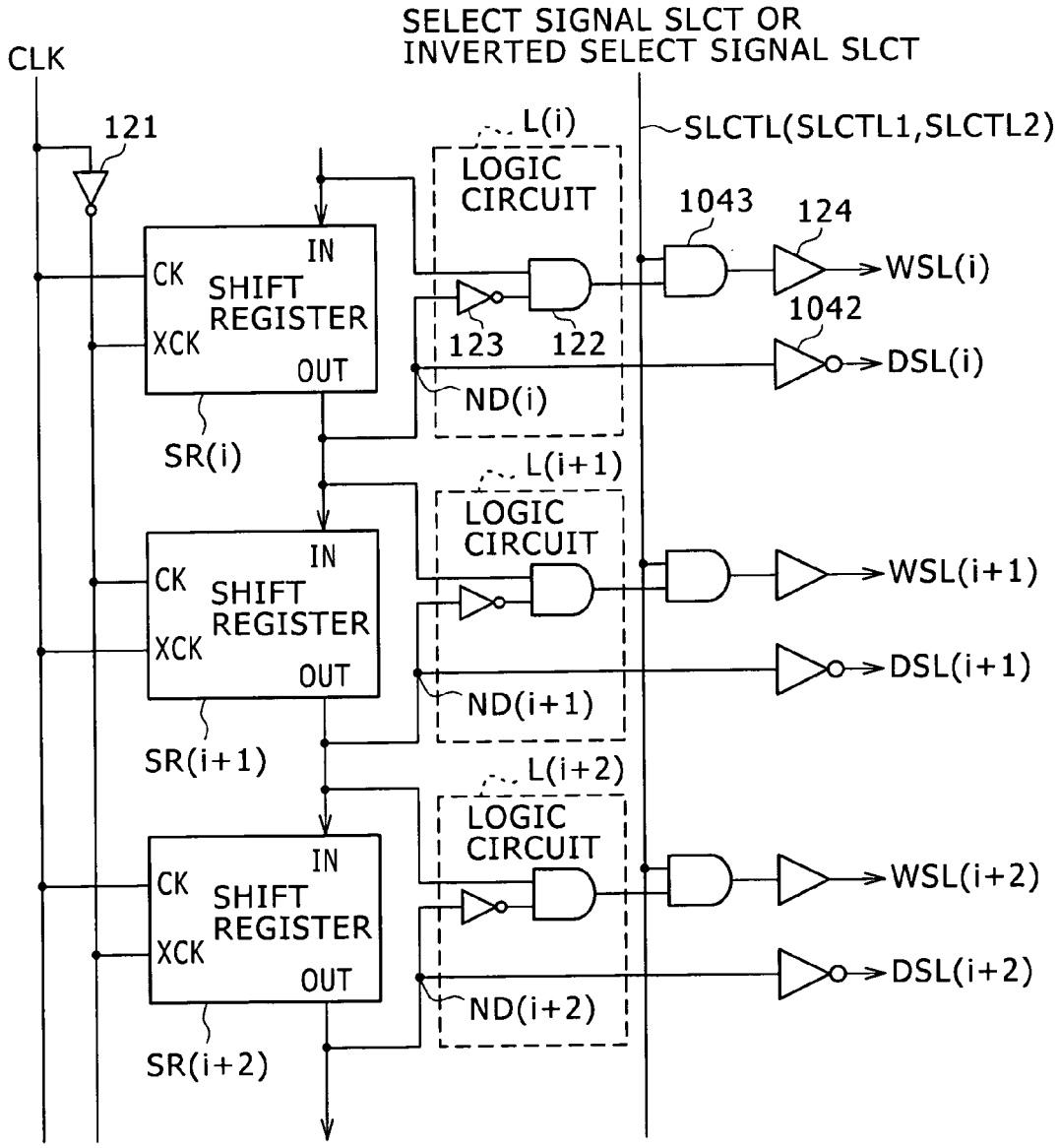
FIG. 12 is a block diagram showing an example of a circuit configuration of the vertical scanner of FIG. 11.

FIG. 12 shows an example of a circuit configuration of the vertical scanner 104.

Referring to FIG. 12, shift transistors SR(i) to SR(i+2) are connected in series. The shift transistors SR(i) to SR(i+2) have a clock input terminal CK, an inverted clock input terminal XCK, an input terminal IN and an output terminal OUT, to which a clock signal CLK, an inverted clock signal XCLK, and an input signal INS are inputted and from which an output signal OUTS is outputted, respectively. Further, logic circuits L(i) to L(i+2) include an AND gate 122 and an inverter 123. Here, the suffix i indicates a shift register or the like on the ith stage.

For example, the ith shift register SR(i) is connected at the input terminal IN thereof to a first input terminal of the AND gate 122 and at the output terminal OUT thereof to an input terminal of the inverter 123 and an input terminal of the output buffer 124 through a node NDi.

The inverter 123 is connected at the input terminal thereof to the node NDi and at an output terminal thereof to a second input terminal of the AND gate 122.

The AND gate 122 is connected at the first input terminal thereof to the input terminal IN of the shift register SR(i), at the second input terminal thereof to the output terminal of the inverter 123 and at an output terminal thereof to a second input terminal of the AND gate 1043. The AND gate 1043 is connected at a first input terminal thereof to the select signal line SLCTL, at the second input terminal thereof to the output terminal of the AND gate 122 and at the output terminal thereof to the input terminal of the output buffer 124.

The output buffer 124 is connected at the input terminal thereof to the output terminal of the AND gate 1043 and at an output terminal thereof to the scanning line WSL(i). The inverter 1042 is connected at the input terminal thereof to the node NDi and at an output terminal thereof to the driving line DSL(i).

It is to be noted that the select signal line SLCTL shown in FIG. 12 represents one of the select signal lines SLCT1 and SLCT2. For example, where the shift register SR(i) is disposed in the first region REG1, the select signal line SLCTL represents the second select signal line SLCTL2, but where the shift register SR(i) is disposed in the second region REG2, the select signal line SLCTL represents the first select signal line SLCTL1.

A similar connection scheme also is used for the shift registers SR(i+1) and SR(i+2).

Now, the operation of the components of the vertical scanner 104 is described taking the ith shift register SR(i) as an example.

The driving line DSL(i) reflects the output signal OUTS of the shift register SR(i) irrespective of the select signal SLCT. The output signal OUTS of the shift register SR(i) is inverted in signal level by the output buffer 124. When the output signal OUTS has the high level, the light emitting device emits light, but when the output signal OUTS has the low level, the light emitting device emits no light.

(A) Operation when the Select Signal SLCT is Kept at the High Level is Described.

If the shift register SR(i) receives the input signal INS of the high level and outputs the output signal OUTS of the low level, then the AND gate 122 receives a signal of the high level at the first input terminal thereof and receives a signal of the high level inverted by the inverter 123 at the second input terminal thereof. Then, the AND gate 122 outputs a signal of the high level.

Then, the AND gate 1043 receives a signal of the high level at the first input terminal thereof and receives a signal of the high level outputted from the AND gate 122 at the second input terminal thereof. Then, the AND gate 1043 propagates a signal of the high level to the scanning line WSL(i).

Then, if the shift register SR(i) receives the input signal INS of the high level and outputs the output signal OUTS of the high level, then the AND gate 122 receives a signal of the high level at the first input terminal thereof and a signal of the low level inverted by the inverter 123 at the second input terminal. Then, the AND gate 122 outputs a signal of the low level.

Then, the AND gate 1043 receives a signal of the high level at the first input terminal thereof and a signal of the low level outputted from the AND gate 122 at the second input terminal thereof, and outputs a signal of the low level. The output buffer 124 receives a signal of the low level from the AND gate 1043 and propagates a signal of the low level to the scanning line WSL(i).

Then, if the shift register SR(i) receives the input signal INS of the low level and outputs the output signal OUTS of the high level, then the AND gate 122 receives a signal of the low level at the first input terminal thereof and receives a signal of the low level inverted by the inverter 123 at the second input terminal thereof. Then, the AND gate 122 outputs a signal of the low level.

Then, the AND gate 1043 receives a signal of the high level at the first input terminal thereof and receives a low level signal outputted from the AND gate 122 at the second input terminal thereof, and outputs a signal of the low level. The output buffer 124 receives a signal of the low level from the AND gate 1043 and propagates a signal of the low level to the scanning line WSL(i).

On the other hand, if the shift register SR(i) receives the input signal INS of the low level and outputs the output signal OUTS of the low level, then the AND gate 122 receives a signal of the low level at the first input terminal thereof and receives a signal of the high level inverted by the inverter 123 at the second input terminal thereof. Then, the AND gate 122 outputs a signal of the low level.

Then, the AND gate 1043 receives a signal of the high level at the first input terminal thereof and receives a signal of the low level outputted from the AND gate 122 at the second input terminal thereof, and outputs a signal of the low level. The output buffer 124 receives a signal of the low level from the AND gate 1043 and propagates a signal of the low level to the scanning line WSL(i).

(B) Operation when the Select Signal SLCT is Kept at the Low Level is Described.

Since a signal of the low level is inputted to the first input terminal of the AND gate 1043, the output of the AND gate 1043 exhibits the low level. Accordingly, the scanning line WSL(i) exhibits the low level irrespective of the signal level of the input and output signals of the shift register SR(i).

As described above, only when a state of the select signal SLCT is selected and the shift register SR(i) receives the input signal INS of the high level and outputs the output signal OUTS of the low level, a signal of the high level is propagated to the scanning line WSL(i) to carry out writing of pixels.

Now, the operation of the shift registers according to the present configuration example is described.

FIG. 13 shows an example of an equivalent model of the shift registers.

Referring to FIG. 13, the shift register SR(i) according to the present configuration example has a clock input terminal CK, an inverted clock input terminal XCK, an input terminal IN and an output terminal OUT.

The shift register SR(i) operates at a rising edge of a clock signal CLK and an inverted clock signal XCLK.

FIGS. 14A to 14D illustrate the operation of the shift register shown in FIG. 13.

The clock signal CLK illustrated in FIG. 14A and the inverted clock signal XCLK illustrated in FIG. 14*b* are inputted to the clock input terminal CK and the inverted clock input terminal XCK, respectively.

If the input signal INS illustrated in FIG. 14C is inputted to the input terminal IN of the shift register SR(i), then since the input signal INS has the low level, the shift register SR(i) outputs such an output signal OUTS of the low level, as seen in FIG. 14D, from the output terminal OUT and then keeps the low level until a next rising edge of the clock signal CLK.

Then, at the second rising edge of the clock signal CLK, since the input signal INS has the high level, the shift register SR(i) outputs the output signal OUTS of the high level and keeps the output signal OUTS of the low level until a next third rising edge of the clock signal CLK.

At the third rising edge of the clock signal CLK, since the input signal INS has the low level, the shift register SR(i) outputs the output signal OUTS of the low level and keeps the output signal OUTS of the low level until a fourth rising edge of the clock signal CLK (not shown).

In this manner, the shift register SR(i) successively shifts the input signal INS by one stage in synchronism with the clock signal CLK and outputs the shifted input signal INS.

Now, the operation of the vertical scanner 104 is described with reference to FIGS. 15A to 15S.

FIGS. 15A to 15S are timing charts of the vertical scanner 104 according to the present configuration example. In particular, FIGS. 15A to 15C illustrate the clock signal CLK, the start signal SCLK and the select signal SLCT, respectively; FIGS. 15D to 15K illustrate scanning signals propagated along the scanning lines WSL1 to WSL244; and FIGS. 15L to 15S illustrate driving signals propagated along the driving lines DSL1 to DSL244. It is to be noted that the scanning signals and the driving signals illustrated in FIGS. 15D to 15S only show part thereof.

As seen from FIGS. 15D to 15K, an on/off scanning signal is propagated once within a period of one field along each of the scanning lines WSL1 to WSL480, and as seen from FIGS. 15L to 15S, an on/off driving signal is propagated twice within a period of one field along the driving lines DSL1 to DSL480. It is to be noted that, in an initial state, the input and output signals of all the shift registers SR1 to SR480 are set to the low level.

As seen in FIG. 15A, the clock signal CLK of 480 pulses is inputted to each of the shift registers SR1 to SR480 of the vertical scanner 104 within a period of one field, and as seen in FIG. 15B, the start signal SCLK is inputted to the shift register SR1 at the first stage.

Further, the shift registers SR1 to SR480 receive the input signal INS and output the output signal OUTS to the logic circuits L1 to L480.

As seen in FIG. 15A, the clock signal CLK is inputted to the shift registers SR1 to SR480. Further, such a start signal SCLK, as seen in FIG. 15B, is inputted to the shift register SR1. The start signal SCLK has a period of a scanning signal equal to twice that of the driving signal, that is, it has the period of emission of light of the light emitting device 116 illustrated in FIG. 10

The select signal SLCT is kept at the high level, as seen in FIG. 15C, until the 240th stage in the first region REG1 is scanned and then kept at the low level on the 241st to 480th stages in the second region REG2.

Within the period in which the select signal SLCT is kept at the high level, the first region REG1 is selected, but within the period within which the select signal SLCT is kept at the low level, the second region REG2 is selected.

At a first rising edge of the clock signal CLK, the start signal SCLK of the high level illustrated in FIG. 15B is inputted to the shift register SR1. Further, at this time, the output signal OUTS of the shift register SR1 is kept at the initial low level.

Accordingly, as seen in FIG. 15D, the scanning line WSL1 is changed over to the high level and is kept at the high level until a next rising edge of the clock signal CLK while writing into the pixels on the scanning line WSL1 is carried out.

Since both the input signal INS and the output signal OUTS of the shift registers SR2 to SR480 have the low level, the scanning lines WSL2 to WSL480 are kept at the low level and writing into the pixel circuits 101 is not carried out. Further, the output signals OUTS of all the shift registers SR1 to SR480 and the driving lines DSL1 to DSL480 are kept at the low level, and the light emitting devices 116 do not emit light.

At a second rising edge of the clock signal CLK, the input signal INS of the shift register SR1 is kept at the high level, as seen in FIG. 15B.

The shift register SR1 shifts the input signal INS by an amount corresponding to one half clock, and the output signal OUTS of the shift register SR1 and the input signal INS of the shift register SR2 are changed over to the high level. Further, output signal OUTS of the shift register SR2 and the input and output signals of the shift registers SR3 to SR480 are all kept at the low level.

Accordingly, as seen in FIG. 15E, the scanning signal of the scanning line WSL1 is changed over to the low level, and the scanning signal of the scanning line WSL2 is changed over to the high level. Then, the scanning signal of the scanning line WSL2 is kept at the high level until a next rising edge of the clock signal CLK, and writing into the pixel circuits 101 on the scanning line WSL2 is carried out. Further, as seen in FIG. 15L, the light emitting devices 116 on the driving line DSL1 carry out first time light emission within a period within which the start signal SCLK is kept at the high level.

At a third rising edge of the clock signal CLK, the input signal INS of the shift register SR1 is kept at the high level, as seen in FIG. 15B.

The shift register SR1 shifts the input signal INS by one half clock, and the output signal OUTS of the shift register SR1 and the input signal INS of the shift register SR2 are kept at the high level.

The shift register SR2 shifts the input signal INS by one half clock, and the output signal OUTS of the shift register SR2 and the input signal INS of the shift register SR3 are kept at the high level. Further, the output signal OUTS of the shift register SR3 and the input and output signals of the shift registers SR4 to SR480 are kept at the low level.

Accordingly, as seen in FIG. 15F, the scanning signal of the scanning line WSL2 is changed over to the low level and the scanning signal of the scanning line SL3 is changed over to the high level and kept at the high level until a next rising edge of the clock signal CLK while writing into the pixel circuits 101 on the scanning line SL3 is carried out. Further, as seen in FIG. 15M, the light emitting devices 116 on the driving line DSL2 carry out first time light emission while the start signal SCLK is kept at the high level.

At a fourth rising edge of the clock signal CLK, the input signal INS of the shift register SR1 is kept at the high level as seen in FIG. 15B.

The shift register SR1 shifts the input signal INS by one half clock, and the output signal OUTS of the shift register SR1 and the input signal INS of the shift register SR2 are kept at the high level.

The shift register SR2 shifts the input signal INS by one half clock, and the output signal OUTS of the shift register SR2 and the input signal INS of the shift register SR3 are kept at the high level.

The shift register SR3 shifts the input signal INS by one half clock, and the output signal OUTS of the shift register SR3 and the input signal INS of the shift register SR4 are changed over to the high level. Further, the output signal OUTS of the shift register SR4 and the input and output signals of the shift registers SR5 to SR480 are kept at the low level.

Accordingly, as seen in FIG. 15G, the scanning signal of the scanning line WSL3 is changed over to the low level, and the scanning signal of the scanning line WSL4 is changed over to and kept at the high level until a next rising edge of the clock input terminal CK while writing into the pixel circuits 101 on the scanning line WSL4 is carried out. Further, as seen in FIG. 15N, the light emitting devices 116 on the driving line DSL3 carry out first time light emission within a period within which the start signal SCLK is kept at the high level.

Thereafter, in the first region REG1 within which the select signal SLCT is kept at the high level, the shift registers SR1 to SR480 successively shift the input signal INS by one stage by one half clock in synchronism with the clock signal CLK so that pulses of the scanning signal and the driving signal are successively propagated in the scanning direction until the 240th clock signal CLK is developed.

At the 241st rising edge of the clock signal CLK, the shift register SR240 shifts the input signal INS by one half clock, and the output signal OUTS of the shift register SR240 and the input signal INS of the shift register SR241 are changed over to the high level. Further, the output signal OUTS of the shift register SR241 and the input and output signals of the shift registers SR242 to SR480 are kept at the low level.

Accordingly, as seen in FIG. 15H, the scanning signal of the scanning line WSL240 is changed over to the low level, and the scanning signal of the scanning line WSL241 is changed over to the high level and kept at the high level until a next rising edge of the clock signal CLK while writing into the pixel circuits 101 on the scanning line WSL241 is carried out.

Further, the light emitting devices 116 on the driving line DSL240 carry out first time light emission within a period within which the start signal SCLK is kept at the high level.

At a 242nd rising edge of the clock signal CLK, the shift register S241 shifts the input signal INS by one half clock, and the output signal OUTS of the shift register SR241 and the input signal INS of the shift register SR242 are changed over to the high level. Further, the output signal OUTS of the shift register SR242 and the input and output signals of the shift registers SR243 to SR480 are kept at the low level.

Accordingly, as seen in FIG. 15I, the scanning signal of the scanning line WSL241 is changed over to the low level, and the scanning signal of the scanning line WSL242 is changed over to the high level and kept at the high level until a next rising edge of the clock signal CLK while writing into the pixel circuits 101 on the scanning line WSL242 is carried out. Further, as seen in FIG. 15P, the light emitting devices 116 on the driving line DSL241 carry out second time light emission within a period in which the start signal SCLK is kept at the high level.

Thereafter, in the second region REG2 within which the select signal SLCT is kept at the low level, the shift register SR(i) shifts the input signal INS by one stage in one half clock in synchronism with the clock signal CLK until the 480th clock signal CLK is reached. Thus, pulses of the scanning signal and the driving signal are successively propagated in the scanning direction, as seen in FIGS. 15J to 15K and 15Q to 15S.

As described above, according to the present configuration example, even if the signal periods of the scanning signal and the driving signal are different from each other, by dividing the vertical scanner 104 in the scanning direction and selectively using the select signals to select the divisional regions, scanning in the same clock period with the shared shift registers can be anticipated.

SECOND CONFIGURATION EXAMPLE

Now, a second configuration example of the vertical scanner is described.

Figure 16:
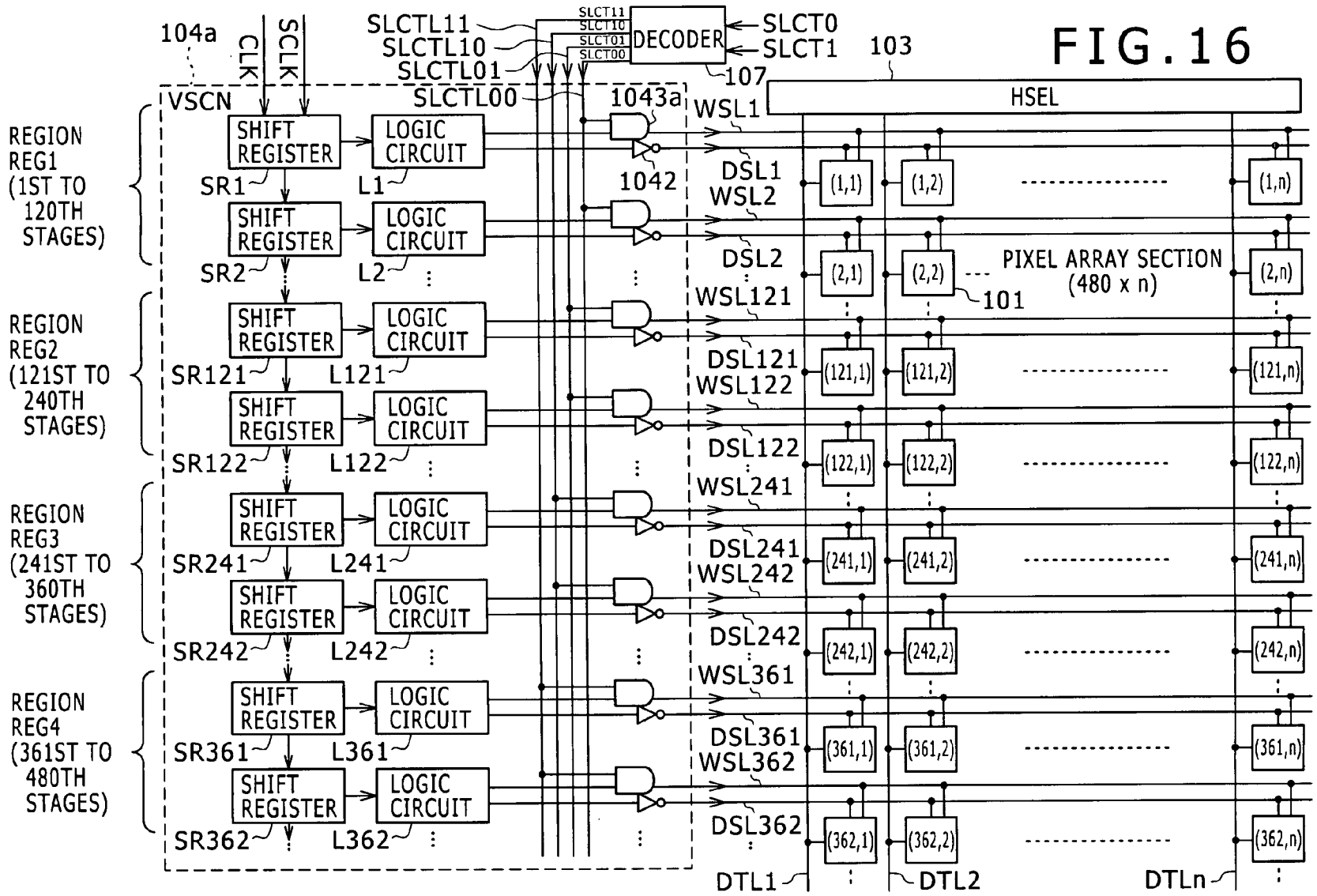
FIG. 16 is a block diagram showing a second example of a configuration of the vertical scanner shown in FIG. 9.

FIG. 16 shows the second configuration example of the vertical scanner.

Referring to FIG. 16, the vertical scanner 104*a* of the second configuration example includes shift registers SR1 to SR480 and logic circuits L1 to L480, similarly as in the vertical scanner 104 of the first configuration example, and has a connection scheme similar to that in the first configuration example. However, in the vertical scanner 104*a*, the area thereof is divided into four regions in the scanning direction. The vertical scanner 104*a* further includes a decoder 107 for selecting a desired one of the divisional regions.

The following description is a simplified description principally of the vertical scanner 104*a*. Therefore, the descriptions of the first auto zero circuit 105, the second auto zero circuit 106, and the first auto zero line AZL1 and second auto zero line AZL2 are omitted here.

In particular, the vertical scanner 104*a* includes a first region REG1 composed of shift registers SR1 to SR120 and logic circuits L1 to L120, a second region REG2 composed of shift registers SR121 to SR240 and logic circuits L121 to L240, a third region REG3 composed of shift registers SR241 to SR360 and logic circuits L241 to L360, and a fourth region REG4 composed of shift registers SR361 to SR480 and logic circuits L361 to L480.

In the present configuration example, in order to carry out the changeover of the regions REG1 to REG4, the vertical scanner 104*a* includes a decoder 107, a first select signal line SLCTL00, a second select signal line SLCTL01, a third select signal line SLCTL10, a fourth select signal line SLCTL11, inverters 1042 for 480 stages, and AND gates 1043*a* for 480 stages.

First Region REG1

In the first region REG1, each of the logic circuits L1 to L120 is connected at a first output terminal thereof to a second input terminal of an AND gate 1043*a* and at a second output terminal thereof to an input terminal of an inverter 1042, each by a signal line. The AND gate 1043*a* is connected at a first input terminal thereof to the first select signal line SLCTL00 and at the second input terminal thereof to a first output terminal of a corresponding one of the logic circuits L1 to L120, each by a signal line. The AND gate 1043*a* is connected at an output terminal thereof to the pixel circuits 101 on the same stage by a corresponding one of the scanning lines WSL1 to WSL120. The inverter 1042 is connected at an output terminal thereof to the pixel circuits 101 on the same stage by a corresponding one of the driving lines DSL1 to DSL120.

Second Region REG2

In the second region REG2, each of the logic circuits L121 to L240 is connected at a first output terminal thereof to a second input terminal of an AND gate 1043*a* and at a second output terminal thereof to an input terminal of an inverter 1042, each by a signal line. The AND gate 1043*a* is connected at a first input terminal thereof to the second select signal line SLCTL01 and at the second input terminal thereof to a first output terminal of a corresponding one of the logic circuits L121 to L240, each by a signal line. The AND gate 1043*a* is connected at an output terminal thereof to the pixel circuits 101 on the same stage by a corresponding one of the scanning lines WSL121 to WSL240. The inverter 1042 is connected at an output terminal thereof to the pixel circuits 101 on the same stage by a corresponding one of the driving lines DSL121 to DSL240.

Third Region REG3

In the third region REG3, each of the logic circuits L241 to L360 is connected at a first output terminal thereof to a second input terminal of an AND gate 1043*a* and at a second output terminal thereof to an input terminal of an inverter 1042, each by a signal line. The AND gate 1043*a* is connected at a first input terminal thereof to the third select signal line SLCTL10 and at the second input terminal thereof to a first output terminal of a corresponding one of the logic circuits L241 to L360, each by a signal line. The AND gate 1043*a* is connected at an output terminal thereof to the pixel circuits 101 on the same stage by a corresponding one of the scanning lines WSL241 to WSL360. The inverter 1042 is connected at an output terminal thereof to the pixel circuits 101 on the same stage by a corresponding one of the driving lines DSL241 to DSL360.

Fourth Region REG4

In the fourth region REG4, each of the logic circuits L361 to L480 is connected at a first output terminal thereof to a second input terminal of an AND gate 1043*a* and at a second output terminal thereof to an input terminal of an inverter 1042, each by a-signal line. The AND gate 1043*a* is connected at a first input terminal thereof to the fourth select signal line SLCTL11 and at the second input terminal thereof to a first output terminal of a corresponding one of the logic circuits L361 to L480, each by a signal line. The AND gate 1043*a* is connected at an output terminal thereof to the pixel circuits 101 on the same stage by a corresponding one of the scanning lines WSL361 to WSL480. The inverter 1042 is connected at an output terminal thereof to the pixel circuits 101 on the same stage by a corresponding one of the driving lines DSL361 to DSL480.

The first select signal line SLCTL00, the second select signal line SLCTL01, the third select signal line SLCTL10, and the fourth select signal line SLCTL11 are connected to the decoder 107.

A select signal SLCT0 and another select signal SLCT1 are inputted to the decoder 107. The decoder 107 carries out a predetermined process and outputs select signals SLCT00, SLCT01, SLCT10 and SLCT11 to the select signal lines SLCTL00, SLCTLO1, SLCTL10 and SLCT11, respectively.

Now, the selection of the regions REG1 to REG4 in the present configuration example is described.

Selection of the First Region REG1

If the select signal SLCT0 of the low level and the select signal SLCT1 of the low level are inputted to the decoder 107, then the decoder 107 outputs the select signal SLCT00 of the high level, the select signal SLCT01 of the low level, the select signal SLCT10 of the low level, and the select signal SLCT11 of the low level. At this time, the first region REG1 is selected and writing into the pixel circuits 101 connected to the scanning lines WSL1 to WSL120 is carried out.

Selection of the Second Region REG2

If the select signal SLCT0 of the high level and the select signal SLCT1 of the low level are inputted to the decoder 107, then the decoder 107 outputs the select signal SLCTO0 of the low level, the select signal SLCT01 of the high level, the select signal SLCT10 of the low level, and the select signal SLCT11 of the low level. At this time, the second region REG2 is selected and writing into the pixel circuits 101 connected to the scanning lines WSL121 to WSL240 is carried out.

Selection of the Third Region REG3

If the select signal SLCT0 of the low level and the select signal SLCT1 of the high level are inputted to the decoder 107, then the decoder 107 outputs the select signal SLCT00 of the low level, the select signal SLCT01 of the low level, the select signal SLCT10 of the high level, and the select signal SLCT11 of the low level. At this time, the third region REG3 is selected and writing into the pixel circuits 101 connected to the scanning lines WSL241 to WSL360 is carried out.

Selection of the Fourth Region REG4

If the select signal SLCT0 of the high level and the select signal SLCT1 of the high level are inputted to the decoder 107, then the decoder 107 outputs the select signal SLCT00 of the low level, the select signal SLCT01 of the low level, the select signal SLCT10 of the low level, and the select signal SLCT11 of the high level. At this time, the fourth region REG4 is selected and writing into the pixel circuits 101 connected to the scanning lines WSL361 to WSL480 is carried out.

To the driving lines DSL1 to DSL480, signals from the logic circuits L1 to L480 are propagated, respectively.

The operation of the present vertical scanner 104*a* is described with reference to FIGS. 17A to 17X.

Figures 17A, 17B, 17C, 17D, 17E, 17F, 17G, 17H, 17I, 17J, 17K, 17L, 17M, 17N, 17O, 17P, 17Q, 17R, 17S, 17T, 17U, 17V, 17W, 17X:
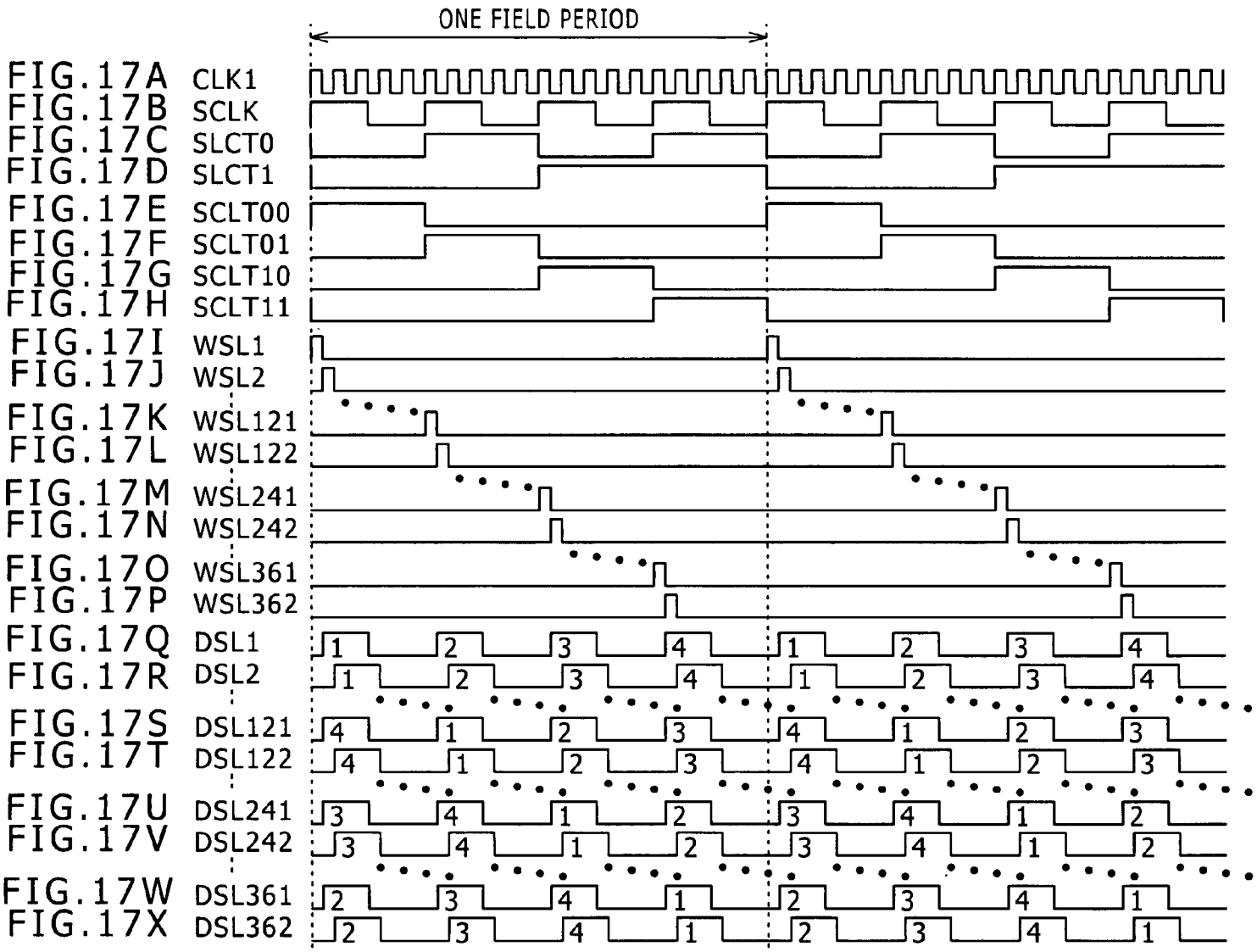
FIGS. 17A to 17X are timing charts illustrating the operation of the vertical scanner of FIG. 16.

FIGS. 17A to 17X illustrate the operation of the vertical scanner 104*a* according to the present configuration example. In particular, FIG. 17A illustrates the clock signal CLK; FIG. 17B illustrates the start signal SCLK; FIG. 17C illustrates the select signal SLCT0; FIG. 17D illustrates the select signal SLCT1; FIG. 17E illustrates the select signal SLCT00; FIG. 17F illustrates the select signal SLCT01; FIG. 17G illustrates the select signal SLCT10; FIG. 17H illustrates the select signal SLCT11; FIGS. 17I to 17P illustrate scanning signals propagated to the scanning lines WSL1 to WSL362; and FIGS. 17Q to 17X illustrate driving signals propagated to the driving lines DSL1 to DSL362. It is to be noted that the scanning signals and the driving signals illustrated in FIG. 17 only are shown at a part thereof.

An on/off scanning signal is propagated once within a period of one field to the scanning lines WSL1 to WSL480, and an on/off driving signal is outputted four times within a period of one field to the driving lines DSL1 to DSL480. It is to be noted that the input and output signals of the shift registers SR1 to SR480 initially have the low level.

As seen in FIG. 17A, the clock signals CLK of the same period are inputted to the shift registers SR1 to SR480. Further, as seen in FIG. 17B, the start signal SCLK of a period equal to four times the period of light emission of the light emitting devices 116 is inputted to the shift register SR1 at the first stage.

As seen in FIG. 17C, a signal of a period equal to twice the period of the start signal SCLK is propagated to the select signal SLCT0. Further, another signal of a period four times that of the start signal SCLK is propagated to the select signal SLCT1, as seen in FIG. 17D.

Then, as seen in FIGS. 17E to 17H, the decoder 107 outputs the select signals SLCT00, SLCT01, SLCT10 and SLCT11 in response to the signal levels of the select signal SLCT0 and the select signal SLCT1.

In the second configuration example, the decoder 107 successively selects the regions REG1 to REG4 in order, and the vertical scanner 104*a* carries out scanning in the scanning direction in synchronism with the clock signal CLK similarly as in the first configuration example.

The scanning signal generated at a rising edge of such a clock signal CLK, as seen in FIG. 17I, is successively shifted, as seen in FIGS. 17J to 17P, in synchronism with the clock signal CLK to carry out writing into the pixel circuits 101.

Further, the drive signal generated at a rising edge of such a clock signal CLK, as seen in FIG. 17Q, is successively shifted, as seen from FIGS. 17R to 17X, in synchronism with the clock signal CLK, and the light emitting devices 116 emit light four times within a period of one field.

Further, in the present configuration example, while the select signals SLCT00, SLCT01, SLCT10 and SLCT11 have such a signal period that one of them keeps the high level once at any timing, they may otherwise have a different signal period, in which one of them keeps the high level twice.

Further, in the present configuration example, the select signals SLCT00, SLCT01, SLCT10 and SLCT11 for the four divisional regions are provided only with regard to the scanning signal. If select signals for three divisional regions are provided with regard to the driving signals, then the scanning period of the scanning signals can be set to a non-integral multiple, such as 4/3, times the driving period of the driving signals.

Further, in the first and second configuration examples, the driving signals of the driving lines DSL1 to DSL244 have a frequency equal to twice or four times that of the scanning signals of the scanning lines WSL1 to WSL244. If the driving signals of the driving lines DSL1 to DSL244 have such a plurality of frequency components, as are represented by logically ORing a signal of a frequency equal to twice or four times that of the scanning signals and its corresponding frequency of the scanning lines WSL1 to WSL244, then a combination of signals may be carried out by a logic circuit again after a region is selected by the select signals.

With the first and second configuration examples described above, even if the periods of a scanning signal and a driving signal are different from each other, scanning with the same clock frequency can be executed by dividing the region of a vertical scanner in the scanning line direction and selectively using the divisional regions.

With the display apparatus and the driving method thereof according to the present invention, the transfer of a plurality of vertical scanner signals having different periods with the same clock can be shared by the same shift registers. Therefore, an organic EL display apparatus which does not suffer from flickering and displays an image of high picture quality can be provided. Further, since the shift registers can be shared, miniaturization, a reduction in power consumption input signals of an organic EL display apparatus can be anticipated.

While a preferred embodiment of the present invention has been described using specific terms, such description is for illustrative purpose only, and it is to be understood that changes and variations may be made without departing from the spirit or scope of the following claims.

What is claimed is:

1. A display apparatus comprising:

a pixel array section having a plurality of pixel circuits, at least one of the plurality of pixel circuits including:

a light-emitting device;

a capacitor, a drive transistor having a gate, a first current terminal, and a second current terminal, the first current terminal of the drive transistor connected to the light-emitting device;

a first switching transistor configured to supply a data signal from a data line to the capacitor; and a second switching transistor configured to connect the second current terminal of the drive transistor and a power supply line; and a peripheral section having a drive circuit configured to supply a first scanning signal and a second scanning signal, wherein the first switching transistor is configured to be turned on once according to the first scanning signal within a field period, and wherein the second switching transistor is configured to be turned on four times according to the second scanning signal within the field period.

2. The display apparatus according to claim 1, wherein the first scanning signal and the second scanning signal are supplied from the peripheral section disposed on one side of the pixel array section.

3. The display apparatus according to claim 1, wherein the drive circuit includes a plurality of shift registers connected in series.

4. The display apparatus according to claim 3, wherein the drive circuit includes a plurality of inverters; and a decoder configured to provide a plurality of select signal lines to the plurality of inverters.

5. The display apparatus according to claim 4, wherein each of the plurality of inverters is configured to provides the second scanning signal.

6. The display apparatus according to claim 4, the drive circuit is configured to successively select a number of divisional regions according to a number of the plurality of select signals.

7. The display apparatus according to claim 4, the drive circuit is configured to control the first switching transistor and the second switching transistor in response to input and output states of the plurality of shift registers.

8. The display apparatus according to claim 3, wherein the plurality of shift registers is configured to receive a clock signal of the same period.

9. The display apparatus according to claim 3, wherein a start signal of a period equal to four times a period of light emission of the light-emitting device is inputted to one of the plurality of shift registers.

* * * * *